US005368448A

United States Patent [19]

Maruno et al.

[11] Patent Number: 5,368,448

[45] Date of Patent: Nov. 29, 1994

[54] VARIABLE-STROKE CRANK MECHANISM

[75] Inventors: Fujiya Maruno, Tokyo; Shoji Ohta, Fujimi; Shyuji Ichijoh, Asaka, all of Japan

[73] Assignee: Honda Giken Kogyo Kabushiki Kaisha, Tokyo, Japan

[21] Appl. No.: 24,002

[22] Filed: Feb. 26, 1993

[30] Foreign Application Priority Data

Feb. 27, 1992 [JP] Japan ..... 4-076288
Dec. 15, 1992 [JP] Japan ..... 4-354096

[51] Int. Cl.[5] ..... F04B 1/06

[52] U.S. Cl. ..... 417/221; 417/273; 91/492; 91/497; 92/12.1

[58] Field of Search ..... 92/12.1, 13; 91/491, 91/492, 494, 495, 497, 498; 417/221, 273

[56] References Cited

U.S. PATENT DOCUMENTS

| | | | |
|---|---|---|---|
| 2,115,121 | 4/1938 | Phillips | 417/221 |
| 2,316,115 | 4/1943 | Thompson | 91/495 |
| 2,392,754 | 1/1946 | Mercier | 91/494 |
| 3,892,167 | 7/1975 | Becker | 91/497 |
| 4,006,668 | 2/1977 | Steiger | 91/497 |
| 4,126,994 | 11/1978 | Rockwell | 60/420 |
| 5,076,057 | 12/1991 | Maruno | 60/487 |
| 5,279,208 | 1/1994 | Kyrlin | 91/497 |
| 5,280,745 | 1/1994 | Maruno | 417/273 |

FOREIGN PATENT DOCUMENTS 0394061 10/1990 European Pat. Off. .
3-37465 2/1991 Japan .

*Primary Examiner*—Richard A. Bertsch
*Assistant Examiner*—Peter Korytnyk
*Attorney, Agent, or Firm*—Lyon & Lyon

[57] ABSTRACT

A variable-stroke crank mechanism has a crankshaft rotatably supported in a casing for relative rotation about an axis with a crankpin displaced out of alignment with the axis. An eccentric collar is rotatably mounted on the crankpin for revolving around the axis in response to the relative rotation of the crankshaft with respect to the casing to reciprocally move an actuator relative to the casing. A stroke adjusting mechanism for adjusting angular displacement of the eccentric collar on the crankpin comprises an internal ring gear integral with the eccentric collar concentrically with the crankpin, a planetary pinion rotatably mounted on the crankshaft and meshing with the internal ring gear, a sun gear meshing with the planetary pinion, and a stroke adjusting shaft rotatably disposed axially in a portion of the crankshaft and coupled to the sun gear, whereby the stroke adjusting shaft is adjustable in angular displacement to adjust a stroke of reciprocating movement of the actuator.

22 Claims, 18 Drawing Sheets

VARIABLE-STROKE CRANK MECHANISM

BACKGROUND OF THE INVENTION

1. Field of the Invention

The present invention relates to a variable-stroke crank mechanism for use in a radial-plunger variable-displacement fluid device having cylinders and plungers whose axes extend radially around a crankshaft, and more particularly to a variable-stroke crank mechanism suitable for use in a radial-plunger variable-displacement fluid device of the double crankpin type.

2. Description of the Prior Art

Radial-plunger variable-displacement fluid devices in which cylinders and plungers have axes extending radially around a crankshaft are well known in the art of hydraulic pumps, hydraulic motors, and compressors. For example, U.S. Pat. No. 5,076,057 discloses a plunger-type hydraulic unit as a radial-plunger variable-displacement fluid device.

In the disclosed plunger-type hydraulic unit, an off-center crankpin is mounted on a rotatable crankshaft, and an eccentric collar is mounted on the crankpin. Plungers are coupled to a connecting ring that is rotatably mounted on the eccentric collar, and slidably inserted in respective cylinders fastened to a casing.

When the crankshaft rotates, the crankpin and the eccentric collar also rotate in unison with the crankshaft. The plungers now reciprocate in the respective cylinders as the connecting ring revolves around the axis of the crankshaft. The plunger-type hydraulic unit includes a mechanism for rotating the eccentric collar in unison with the crankshaft.

Since the reciprocating stroke of the plungers can be varied by adjusting the rotational position of the eccentric collar on the crankpin, the above mechanism is used as a stroke adjusting mechanism for adjusting the rotational position of the eccentric collar.

In the conventional radial-plunger variable-displacement fluid device, the single crankpin is mounted on the crankshaft, and the plungers and cylinders are arrayed radially around the crankpin. The radial-plunger variable-displacement fluid device is often required to have a large displacement. To increase the displacement, however, it is necessary to increase the diameters of the plungers and cylinders or the reciprocating stroke of the plungers.

To increase the diameters of the plungers and cylinders, it is then necessary to prevent adjacent ones of the cylinders from interfering with each other. Accordingly, the plungers and cylinders have to extend radially outwardly for an increased displacement, resulting in an increase in the radial dimension and hence size of the radial-plunger variable-displacement fluid device.

To increase the reciprocating stroke of the plungers, it is necessary to increase the distance by which the crankpin is radially displaced off-center from the axis of the crankshaft. Increasing the off-center distance displaces the plungers and cylinders radially outwardly and increases the length of the cylinders radially outwardly, with the result that the radial-plunger variable-displacement fluid device becomes larger in size.

If two crankpins are mounted on a crankshaft and a radial array of plungers and cylinders is arranged radially of each of the crankpins, then it will be possible to increase the displacement of the device without increasing the size of the device.

However, since two stroke adjusting mechanisms are required in combination with the two respective arrays of plungers and cylinders for adjusting the rotational positions of the eccentric collars on the crankpins to adjust the reciprocating stroke of the plungers, the stroke adjusting mechanisms will be complex in structure and control.

The conventional stroke adjusting mechanism has a drive means extending over the crankshaft to an end thereof for adjusting the rotational position of the eccentric collar. If the same stroke adjusting mechanism design is used for adjusting the stroke of each array of plungers in a double-crankpin radial-plunger variable-displacement fluid device, then the two arrays of plungers and cylinders need to be associated with respective stroke adjusting mechanisms with the drive means extending to the opposite ends of the crankshaft. Therefore, the stroke adjusting mechanisms are rendered complex in structure, and their operation control is also complicated.

SUMMARY OF THE INVENTION

It is therefore an object of the present invention to provide a variable-stroke crank mechanism which is relatively simple in structure and can be controlled in operation relatively simply.

Another object of the present invention is to provide a variable-stroke crank mechanism suitable for use in a radial-plunger variable-displacement fluid device.

Still another object of the present invention is to provide a double-crankpin variable-stroke crank mechanism which has a single stroke adjusting mechanism for adjusting the strokes of plungers connected to the two crankpins to an identical setting, and which is relatively simple in structure and control.

According to the present invention, there is provided a variable-stroke crank mechanism comprising a casing, a crankshaft rotatably supported in the casing for relative rotation about an axis with respect to the casing, the crankshaft having a crankpin displaced out of alignment with the axis, an eccentric collar rotatably mounted on the crankpin for revolving around the axis in response to the relative rotation of the crankshaft with respect to the casing to reciprocally move an actuator attached to the casing, and a stroke adjusting mechanism for adjusting angular displacement of the eccentric collar on the crankpin.

The stroke adjusting mechanism comprises an internal ring gear integral with the eccentric collar concentrically with the crankpin, a planetary pinion rotatably mounted on the crankshaft and meshing with the internal ring gear, a sun gear meshing with the planetary pinion, and a stroke adjusting shaft rotatably disposed axially in a portion of the crankshaft and coupled to the sun gear, whereby the stroke adjusting shaft is adjustable in angular displacement to adjust a stroke of reciprocating movement of the actuator.

According to the present invention, there is also provided a variable-stroke crank mechanism comprising a casing, a double crankshaft rotatably supported in the casing for relative rotation about an axis with respect to the casing, the double crankshaft having a pair of crankpins displaced out of alignment with the axis, and a web disposed between and integral with the crankpins, the crankpins having respective axes positioned symmetrically with respect to the axis, a pair of eccentric collars rotatably mounted on the crankpins, respectively, for revolving around the axis in response to the relative rotation of the double crankshaft with respect to the casing to reciprocally move an actuator attached to the casing, and a stroke adjusting mechanism for adjusting angular displacement of the eccentric collars on the crankpins.

The stroke adjusting mechanism comprises a pair of internal ring gears integral with the eccentric collars, respectively, concentrically with the axes of the crankpins, the internal ring gears being positioned around the web, a pair of planetary pinions rotatably mounted on the web and meshing with the internal ring gears, respectively, a sun gear rotatably disposed in the web and meshing with the planetary pinions, and a stroke adjusting shaft rotatably disposed axially in one of the crankpins and coupled to the sun gear, whereby the stroke adjusting shaft is controlled in rotation to adjust angular displacement of the eccentric collars to adjust a stroke of reciprocating movement of the actuator.

The stroke adjusting shaft extends through one of the crankpins of the double crankshaft. In the double-crankpin stroke adjusting mechanism, the internal ring gears, the planetary pinions, and the sun gear for adjusting the angular displacement of the eccentric collars are disposed in the web that is positioned intermediate between the crankpins, and the stroke adjusting shaft is coupled to the sun gear. Therefore, the angular displacement of the eccentric collars can be simultaneously adjusted simply controlling the angular movement of the single stroke adjusting shaft. Thus, the stroke adjusting mechanism is simple in structure, and can easily be controlled.

The crankpins of the double crankshaft may be positioned symmetrically with respect to the axis about which the double crankshaft is rotatable. With this arrangement, radial forces acting from plungers on the crankpins are directed in opposite directions and hence canceled out. Consequently, any bending load on the crankshaft and the load on bearings which support the crankshaft are greatly reduced. Any unbalanced load on the crankshaft is also reduced, thus lowering vibrations and noises of the variable-stroke crank mechanism.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

In certain views, the arrows U and R indicate upward and rightward directions with respect to various devices and mechanisms.

Figure 1:
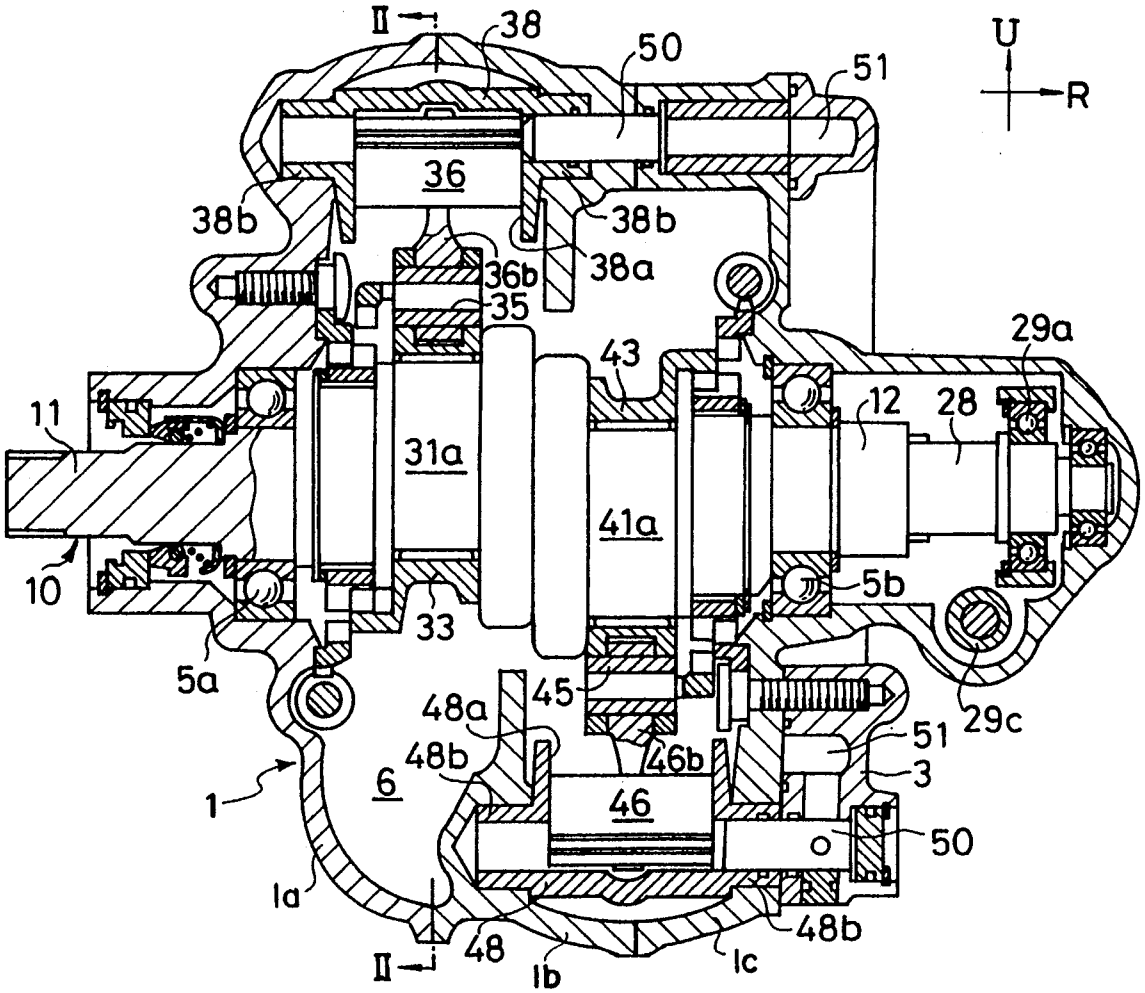
FIG. 1 is a sectional side-elevational view of a radial-plunger variable-displacement fluid device having a variable-stroke crank mechanism according to the present invention.
Figure 2:
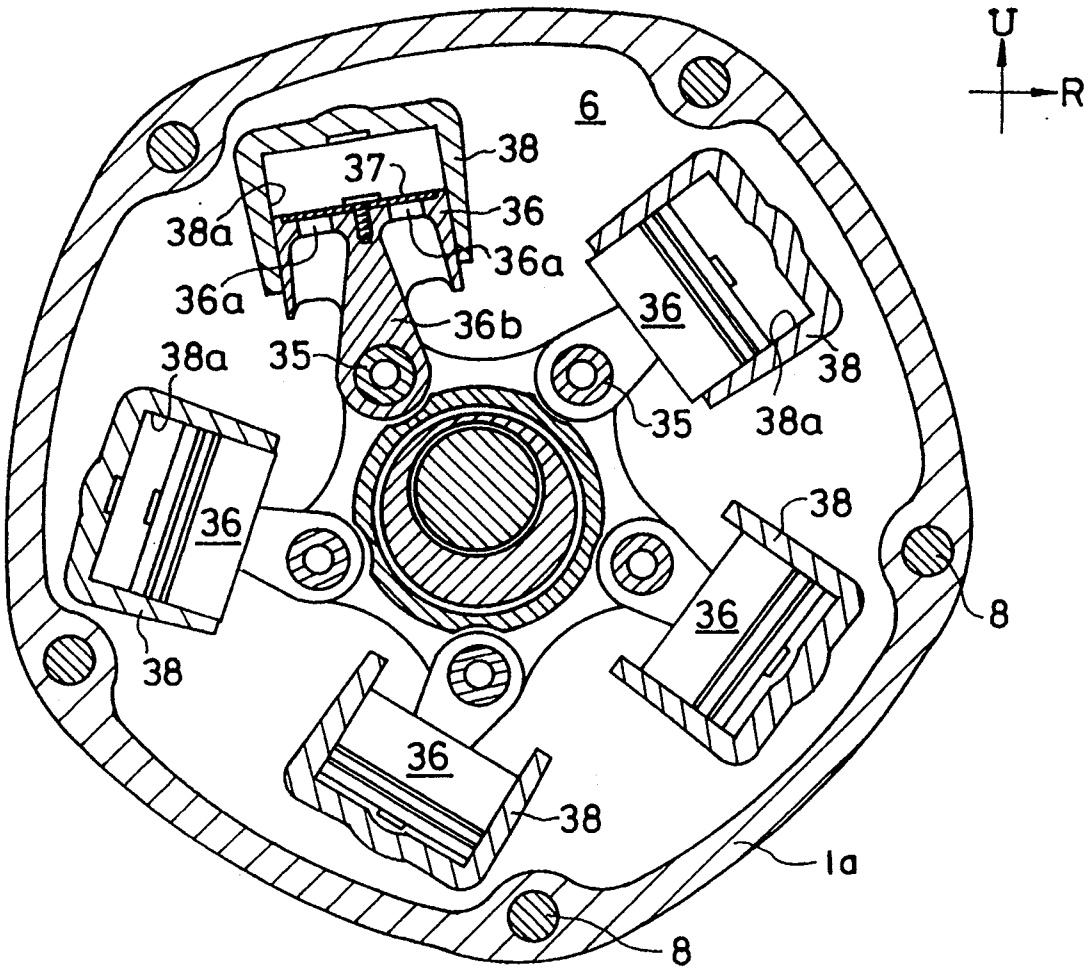
FIG. 2 is a cross-sectional view taken along line II—II of FIG. 1.

FIGS. 1 and 2 show a radial-plunger variable-displacement fluid device having a variable-stroke crank mechanism according to the present invention. The variable-stroke crank mechanism is shown at enlarged scale in FIG. 3.

The radial-plunger variable-displacement fluid device has a casing 1 comprised of three, i.e., left, central, and right, separable casings 1*a*, 1*b*, 1*c* that are fastened together by bolts 8, and a main shaft 10 rotatably supported centrally in the casings 1*a*, 1*b*, 1*c* by bearings 5*a*, 5*b*. A lid 3 having a discharge passage 51 defined therein is coupled to a righthand side of the right casing 1*c*. The discharge passage 51 is also partly defined by the righthand side of the right casing 1*c*.

Figure 3:
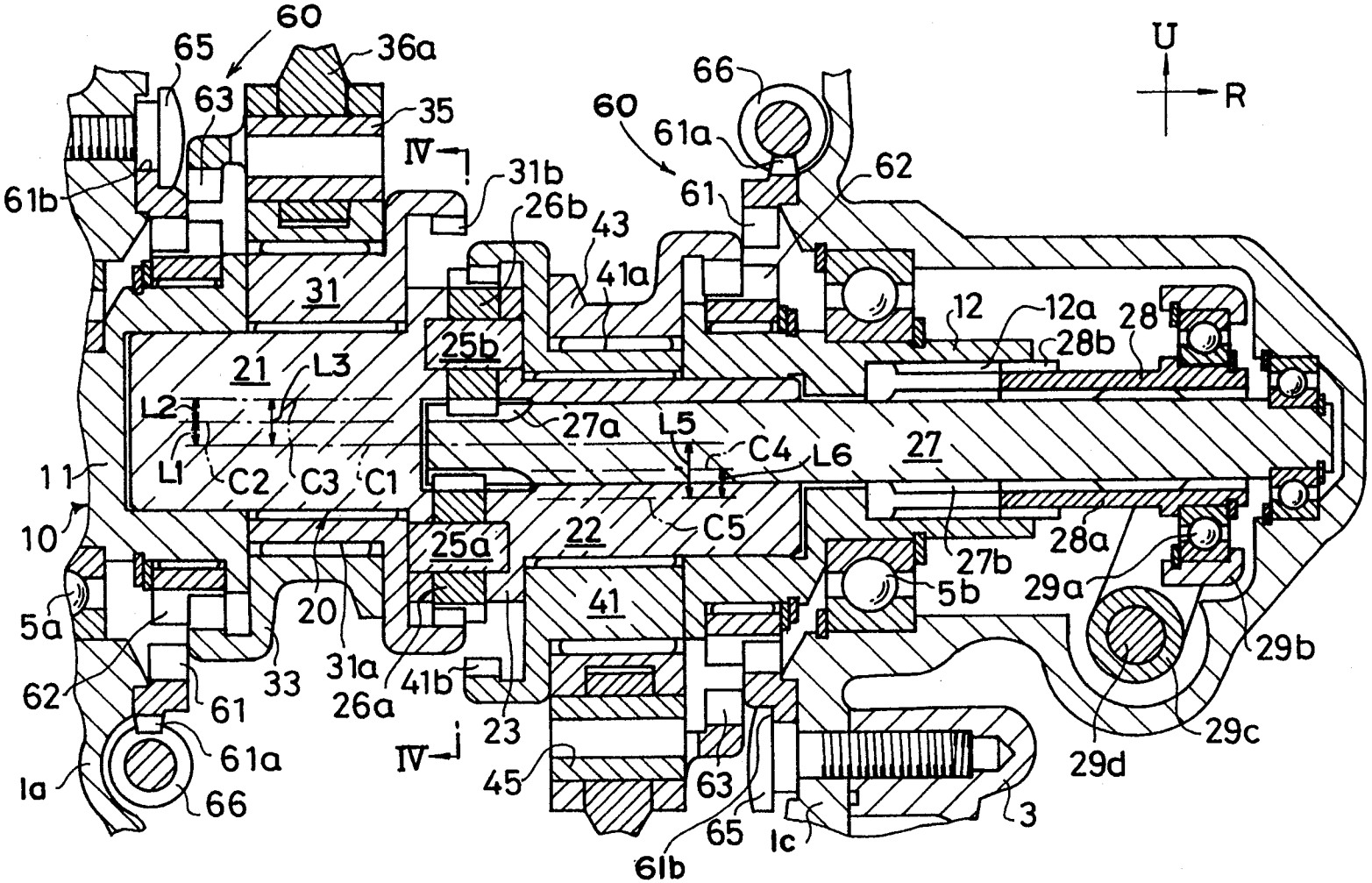
FIG. 3 is an enlarged axial cross-sectional view of the variable-stroke crank mechanism.

As shown in FIG. 3, the main shaft 10 comprises a left shaft portion 11 projecting outwardly from the left casing la for being driven by or driving an external member (not shown), a right shaft portion 12, and a double crankshaft 20 positioned axially between the left and right shaft portions 11, 12, with the left and right shaft portions 11, 12 and the double crankshaft 20 being integrally joined together. The double crankshaft 20 comprises a left crankpin 21 having an off-center axis C2 that is radially spaced a distance L1 (see FIG. 5) from the axis (rotational center) C1 of the main shaft 10, a right crankpin 22 having an off-center axis C4 that is radially spaced a distance L5 from the axis C1, and a web 23 disposed axially between and integrally joining the left and right crankpins 21, 22.

The left and right crankpins 21, 22 are angularly spaced 180° from each other with respect to the axis C1, and the axes C2, C4 are spaced the respective distances L1, L5 from the axis C1 in diametrically opposite directions.

The left and right crankpins 21, 22 are pressfitted respectively in holes defined in the left and right shaft portions 11, 12. Therefore, the left and right shaft portions 11, 12 and the double crankshaft 20 rotate in unison with each other about the axis C1, and the axes C2, C4 of the left and right crankpins 21, 22 revolve around the axis C1.

On the left and right crankpins 21, 22, there are mounted left and right eccentric collars 31, 41, respectively, that are rotatable relative to the left and right crankpins 21, 22, i.e., about the respective axes C2, C4. The left and right eccentric collars 31, 41 have respective outer cylindrical surfaces **31*a*, 41*a* which have respective central axes C3, C5 that are radially spaced respective distances L2, L6 from the axes C2, C4 of the left and right crankpins 21, 22**.

Left and right connecting rings 33, 43 are rotatably mounted respectively on the outer cylindrical surfaces **31*a*, 41*a* of the left and right eccentric collars 31, 41. Thus, the left and right connecting rings 33, 43 are rotatably mounted on the respective left and right eccentric collars 31, 41 respectively for rotation about the central axes C3, C5 of the respective outer cylindrical surfaces 31*a*, 41*a***.

As illustrated in FIGS. 1 and 2, five circumferentially spaced cylinders 38 are disposed radially around the left connecting ring 33, and five circumferentially spaced cylinders 48 are disposed radially around the right connecting ring 43. Each of the cylinders 38 has a pair of left and right trunnions **38*b*, and each of the cylinders 148 has a pair of left and right trunnions 48*b*. The cylinders 38, 48 are rockably supported in the casings 1*a*, 1*b*, 1*c* by the trunnions 38*b*, 48*b*. The trunnions 38*b*, 48*b* have central axes, about which the cylinders 38, 48 are rockable, and are positioned at equal angular intervals on the same radius about the axis C1 of the main shaft 10**.

The cylinders 38, 48 have radially inwardly open cylinder bores **38*a*, 48*a*, respectively, with plungers 36, 46 slidably inserted in the respective radially inwardly open cylinder bores 38*a*, 48*a*. The plungers 36, 46 have respective connecting rods 36*b*, 46*b* projecting radially inwardly and having radially inner ends pivotally supported on the connecting rings 33, 43 by respective hollow pins 35, 45**.

The plungers 36, 46 define inner spaces or cylinder chambers in the respective cylinder bores **38*a*, 48*a*. The cylinder chambers are held in communication with the discharge passage 51 through check valves 50 that are positioned in the righthand trunnions 38*b*, 48*b*. The check valves 50 allow a fluid such as air in the cylinder chambers to flow into the discharge passage 51, but block the fluid flow in the opposite direction, i.e., from the discharge passage 51** into the cylinder chambers.

Each of the plungers 36 has two openings **36*a* defined in its radially outer end, on which a reed valve 37 is mounted in covering relation to the openings 36*a*. Similarly, each of the plungers 46 has two openings (not shown) defined in its radially outer end, on which a reed valve (not shown) is mounted in covering relation to the openings. The reed valves 37 on the plungers 36 and the reed valves on the plungers 46 are flexible enough to allow the fluid to flow from an inner space 6 in the casings 1*a*, 1*b*, 1*c* into the cylinder chambers while lifting the reed valves off the plungers. However, the reed valves prevent the fluid from flowing from the cylinder chambers into the inner space 6**.

The radial-plunger variable-displacement fluid device operates as follows: When the plungers 36, 46 are reciprocally moved in the respective cylinder bores **38*a*, 48*a* by the main shaft 10, the fluid can flow from the inner space 6 in the casings 1*a*, 1*b*, 1*c* into the cylinder chambers while lifting off the reed valves during radially inward movement of the plungers 36, 46 from their top dead center to the bottom dead center. On radially outward movement of the plungers 36, 46 from their bottom dead center to the top dead center, the fluid then flows from the cylinder chambers through the check valves 50 into the discharge passage 51**.

The radial-plunger variable-displacement fluid device has a stroke adjusting mechanism for adjusting the displacement thereof and a double mechanism for ensuring the above operation of the device. The stroke adjusting mechanism and the double mechanism will now be described.

Figure 4:
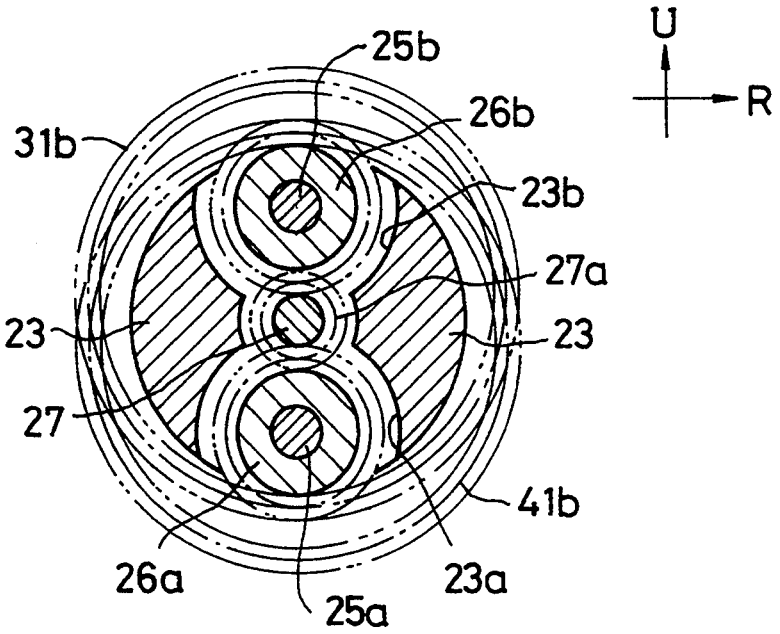
FIG. 4 is a cross-sectional view taken along line IV—IV of FIG. 3, showing a variable-stroke crank mechanism.

The stroke adjusting mechanism has a first internal ring gear **31*b* integrally formed with a righthand side of the left eccentric collar 31 concentrically with the axis C2 of the left crankpin 21, and a second internal ring gear 41*b* integrally formed with a lefthand side of the right eccentric collar 41 concentrically with the axis C4 of the right crankpin 22. As shown in FIG. 4, the web 23 of the double crankshaft 20 has two diametrically opposite gear insertion spaces 23*a*, 23*b* in which first and second planetary pinions 26*a*, 26*b* are rotatably supported by respective pins 25*a*, 25*b*. The first and second planetary pinions 26*a*, 26*b* are held in mesh with the first and second internal ring gears 31*b*, 41*b***, respectively.

The main shaft 10 has a shaft insertion hole defined therein and extending axially from the lefthand end thereof through the right main shaft portion 12 and the right crankpin 22 to the web 23. The shaft insertion hole is connected to the gear insertion holes **23*a*, 23*b* near its axial inner end, and accommodates a stroke adjusting shaft 27 rotatably inserted therein. The stroke adjusting shaft 27 has an integral sun gear 27*a* on its front end, i.e., its left end (FIG. 3), which meshes with the first and second planetary pinions 26*a*, 26*b* as shown in FIGS. 3 and 4**.

When the stroke adjusting gear 27 is rotated about its own axis, it causes the first and second planetary pinions **26*a*, 26*b* to rotate the first and second internal ring gears 31*b*, 41*b* in the same direction about the respective pins 25*a*, 25*b***.

The stroke adjusting shaft 27 has on the outer circumferential surface of its rear end, i.e., its right end (FIG. 3), external splines **27*b* meshing with internal splines 28*a* of a slidable sleeve 28 that is disposed over the stroke adjusting shaft 27. The slidable sleeve 28 has external splines 28*b* on its outer circumferential surface which are held in mesh with internal splines 12*a* of the right main shaft portion 12**.

A shifter ring **29*b* is mounted on the slidable sleeve 28 through a bearing 29*a*, the shifter ring 29*b* engaging a distal end of a shifter lever 29*c*. The shifter lever 29*c* is angularly movably supported on a support shaft 29*d* for angular movement thereabout. When the shifter lever 29a is angularly moved about the support shaft 29d, which extends across the stroke adjusting shaft 27, it causes the shifter ring 29b to move the slidable sleeve 28 axially over the stroke adjusting shaft 27**.

Either the intermeshing pair of external splines 27b and internal splines 28a or the intermeshing pair of external splines 28b and internal splines 12a comprises a pair of helical splines. Therefore, when the slidable sleeve 28 is axially moved by angular movement of the shifter lever 29c, the stroke adjusting shaft 27 rotates about its own axis relatively to the main shaft 10.

Upon rotation of the stroke adjusting shaft 27, the first and second internal ring gears 31b, 41b are rotated by the first and second planetary pinions 26a, 26b, causing the left and right eccentric collars 31, 41 integral with the ring gears 31b, 41b to rotate on the respective crankpins 21, 22.

The rotation of the left and right eccentric collars 31, 41 then adjusts the reciprocating stroke of the plungers 36, 46. The stroke adjustment of the left array of plungers 36 (FIG. 1) will be described in detail with reference to FIG. 5.

It is assumed that the eccentric collar 31 is to be angularly moved in a condition in which the axis C1 of the main shaft 10, the axis C2 of the crankpin 21, and the central axis C3 of the outer cylindrical surface 31a of the eccentric collar 31, i.e., the central axis of the connecting ring 33, are linearly aligned with each other. The axis C2 is radially spaced from the axis C1 by the distance L1, the axis C3 is radially spaced from the axis C2 by the distance L2, and the axis C3 is radially spaced from the axis C1 by a distance L3.

When the main shaft 10 rotates in the condition in which the axes C1, C2, C3 are linearly aligned with each other, the outer circumferential surface 31a of the eccentric collar 31 vertically moves along the direction indicated by the arrow P by a distance 2L3 which is twice the distance L3. Therefore, the connecting ring 33 also vertically moves by the distance 2L3. The reciprocating stroke S of the plungers 36 is determined by the vertical movement of the connecting ring 33. The reciprocating stroke S of the plungers 36 is maximum when the axes C1, C2, C3 are linearly aligned with each other as described above.

Figure 5:
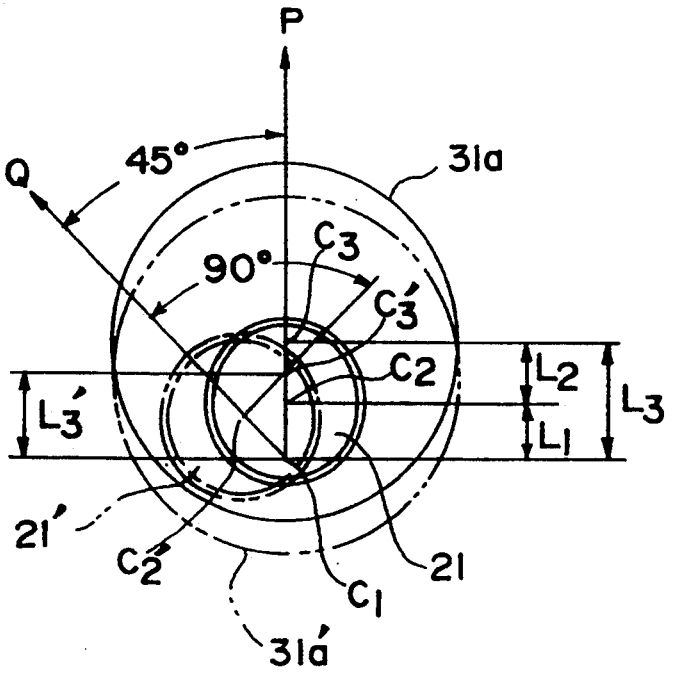
FIG. 5 is a schematic diagram showing the positional relationship between rotating members upon stroke adjustment by the stroke adjusting mechanism.

Now, the eccentric collar 31 is turned from the solid-line position to the two-dot-and-dash-line position in FIG. 5. To keep the center C3 of the outer circumferential surface 31a of the eccentric collar 31 aligned with the direction P, the main shaft 10 is turned 45° counterclockwise, and the eccentric collar 31 is turned 90° clockwise on the crankpin 21.

The crankpin 21 moves to a position 21' with its axis C2 to a position C2'. At the same time, the outer circumferential surface 31a of the eccentric collar 31 moves to a position 31' with its center C3 to a position C3'. As a result, the center C3' of the outer circumferential surface 31a of the eccentric collar 31 is spaced from the axis C1 of the main shaft 10 by a distance L3' (<L3).

When the main shaft 10 then rotates, the outer circumferential surface 31a' of the eccentric collar 31' vertically moves along the direction P by a distance 2L3' which is twice the distance L3'. The connecting ring 33 also vertically moves the distance L3'. Consequently, the reciprocating stroke S of the plungers 36 is reduced.

While the adjustment of the reciprocating stroke S of the left array of plungers 36 has been described above, the reciprocating stroke S of the right array of plungers 46 can similarly be adjusted by turning the right eccentric collar 41.

The left and right eccentric collars 31, 41 rotate in opposite directions upon rotation of the stroke adjusting shaft 27. However, the right eccentric collar 41 only moves in point-symmetry relationship to the movement shown in FIG. 5. Therefore, the reciprocating stroke of the left and right arrays of plungers 36, 46 can be adjusted in the same manner by rotating the stroke adjusting shaft 27.

In order to reciprocally move the plungers 36, 46 upon rotation of the eccentric collars 31, 41 in unison with the main shaft 10 after the stroke of the plungers 36, 46 has been adjusted, it is necessary to cause the connecting rings 33, 43 to revolve around the main shaft 10, rather than to rotate about their own axes. In this embodiment, the double mechanism is employed to cause the connecting rings 33, 43 to revolve around the main shaft 10.

The connecting rings 33, 43 are associated with respective double mechanisms. The double mechanism, generally denoted at 60, which is combined with the connecting ring 33, comprises a first internal gear 61 angularly movably attached to the casing 1 concentrically with the axis C1 of the main shaft 10 for angular movement about the axis C1, an external gear 62 rotatably mounted on the left main shaft portion 11 concentrically with the axis C2 of she left crankpin 21, and a second internal gear 63 integrally formed with the connecting ring 33 concentrically with the axis C3 of the outer circumferential surface 31a of the left eccentric collar 31.

The number Z1 of teeth of the first internal gear 61 is equal to the number Z3 of teeth of the second internal gear 63, and the number Z2 of teeth of the external gear 62 is smaller than the numbers Z1, Z3 of teeth of the first and second internal gears 61, 63. The first internal gear 61 meshes with the external gear 62, which meshes with the second internal gear 63.

The first internal gear 61 has an arcuate guide surface 61b extending along a circumferential surface thereof, and is fastened to the casing 1 by a bolt 65 which is threaded in the casing 1 in contact with the arcuate guide surface 61b. The bolt 65 loosely holds the first internal gear 61 against the casing 1. The first internal gear 61 is angularly movable while the bolt 65 is being in mesh with the arcuate guide surface 61b. The first internal gear 61 also has a worm gear 61a on its outer circumference which is held in mesh with a worm pinion 66 mounted on the casing 1. When the worm pinion 66 is rotated by an external source, the first internal gear 61 is angularly moved about the axis C1.

The double mechanism which is of the same structure as described above is also associated with the right connecting ring 43, and is positioned in point-symmetry relationship to the double mechanism 60 combined with the left connecting ring 33. The parts of the double mechanism which is associated with the right connecting ring 43 are denoted by identical reference characters, and will not be described in detail below.

Figure 6:
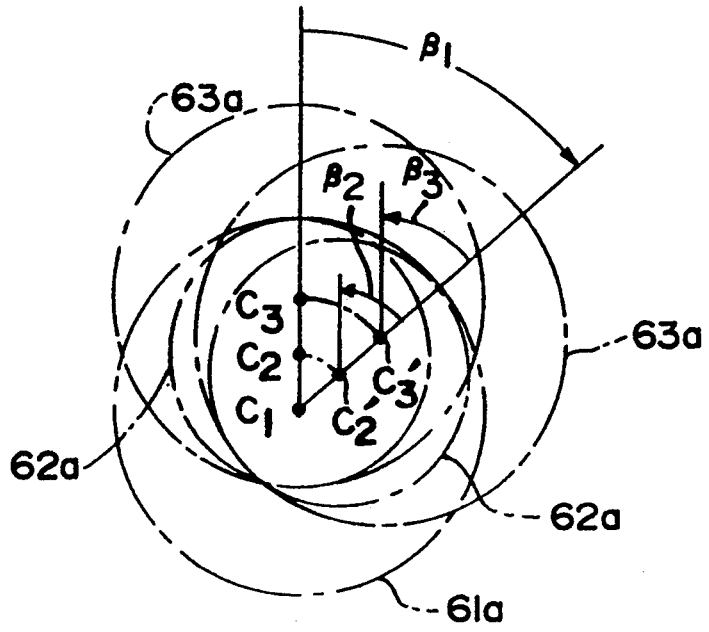
FIG. 6 is a schematic diagram showing the manner in which a double mechanism in the radial-plunger variable-displacement fluid device operates.

Operation of the double mechanism 60 combined with the left connecting ring 33 will be described with reference to FIG. 6.

In the radial-plunger variable-displacement fluid device according to the present invention, the main shaft 10 is rotated. Since the eccentric collar 31 is coupled to the main shaft 10 through the stroke adjusting mechanism, the axis of the crankpin 21, i.e., the axis C2 of the external gear 62, and the axis of the outer circumferential surface 31*a* of the eccentric collar 31, i.e., the axis C3 of the second internal gear 63 revolve around the axis C1 of the main shaft 10 upon rotation of the main shaft 10. For example, when the main shaft 10 rotates through an angle $\beta 1$, the axes C2, C3 also rotate about the axis C1 through the angle $\beta 1$.

Unless the worm pinion 66 is rotated, the first internal gear 61 is fixed to the casing 1. When the axis C2 of the external gear 62 revolves through the angle $\beta 1$, the external gear 62 rotates in the opposite direction through an angle $\beta 2$. Since the numbers of teeth of these gears 61, 62 are inversely proportional to the their rotational angles, the following equation is satisfied:

$$\beta 2 = -Z1/Z2 \times \beta 1 \quad (1).$$

When the external gear 62 rotates through the angle $\beta 2$, the second internal gear 63 rotates through an angle $\beta 3$, which is expressed, using the equation (1), as follows:

$$\beta 3 = Z2/Z3 \times \beta 2 = -Z1/Z3 \times \beta 1 \quad (2).$$

Since a rotational angle (absolute rotational angle) $\beta 4$ of the second internal gear 63 with respect to the first internal gear 61 is equal to the sum of the angles $\beta 1$, $\beta 3$, the rotational angle $\beta 4$ is given by:

$$\beta 4 = (\beta 1 + \beta 3) = (Z3 - Z1)/Z3 \times \beta 1 \quad (3).$$

As can be seen from the equation (3), inasmuch as the numbers Z1, 23 of teeth of the first and second internal gears 61, 63 are equal to each other, the rotational angle $\beta 4$ of the second internal gear 63 is zero, and the second internal gear 63 does not rotate about its own axis.

Therefore, in the variable-displacement fluid device, when the main shaft 10 is rotated with respect to the fixed casings 1*a*, 1*b*, 1*c*, the double mechanism operates as a mechanism for causing the connecting ring 33 to revolve, rather than rotate about its own axis, in response to rotation of the main shaft 10.

When the work pinion 66 is rotated, the phase or angular position of the connecting ring 33 is varied to vary the gap between the ends of the plungers 36 and the ends of the cylinder chambers at the time the plungers 36 are in the top dead center, so that the compression ratio can be adjusted. Such an adjusting process will not be described below as it has no bearing on the present invention.

As described above, the variable-stroke crank mechanism according to the present invention can be used to provide a double-crankpin radial-plunger variable-displacement fluid device. The device may have a multiplicity of cylinders, and its outer dimensions may be reduced while keeping the displacement at a desired level. Stated otherwise, the displacement of the device may be doubled with the outer dimensions remaining the same.

The variable-displacement fluid device may be used as a compressor for compressing air or the like, or a liquid pump or motor.

In the variable-stroke crank mechanism, the stroke adjusting shaft 27 extending axially in the main shaft 10, the planetary pinions 26*a*, 26*b* disposed in the web 23 positioned between the crankpins 21, 22, and the first and second internal ring gears 31*b*, 41*b* integral with the respective left and right eccentric collars 31, 41 jointly constitute the stroke adjusting mechanism. When the rotational position or angular displacement of the stroke adjusting shaft 27 is controlled, the strokes of the left and right arrays of plungers 36, 46 can be adjusted to the same value at the same time. Therefore, the stroke adjusting mechanism is relatively simple in structure and control.

Inasmuch as the two crankpins of the double crankshaft are symmetrically positioned with respect to the center about which the main shaft rotates, radial forces acting from the plungers on the crankpins are directed in opposite directions and hence canceled out. Consequently, any bending load on the main shaft 10 and the load on the bearings 5*a*, 5*b* which support the main shaft 10 are greatly reduced. Any unbalanced load on the main shaft is also reduced, thus lowering vibrations and noises of the device.

The variable-stroke crank mechanism is not limited to the above specific structure. Some other mechanisms will be described below.

In the above embodiment, the first and second planetary pinions 26*a*, 26*b* of the stroke adjusting mechanism are aligned in the same direction as that in which the axes C2, C4 of the left and right crankpins 21, 22 are radially displaced off-center. That is, the centers of the first and second planetary pinions 26*a*, 26*b*, the axes C2, C4 of the left and right crankpins 21, 22, and the axis C1 of the crankshaft 10 are positioned in the same plane.

Figure 7:
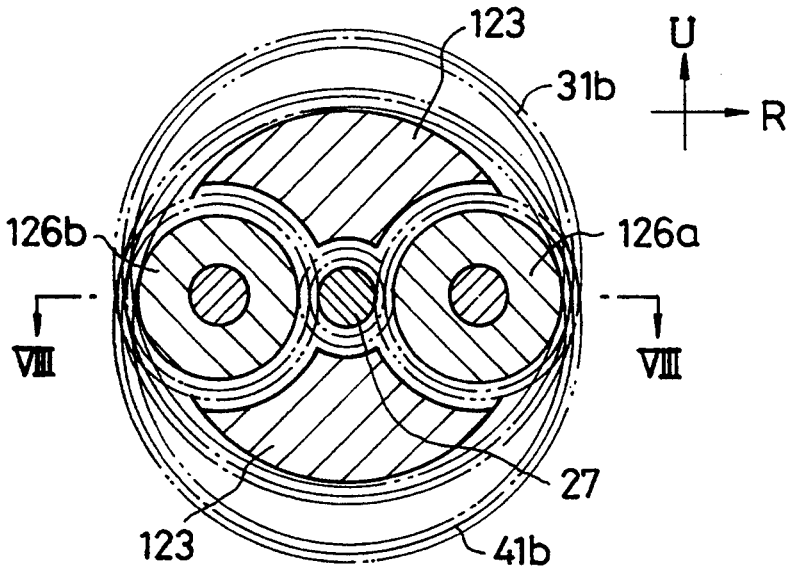
FIG. 7 is a cross-sectional view of another stroke adjusting mechanism.
Figure 8:
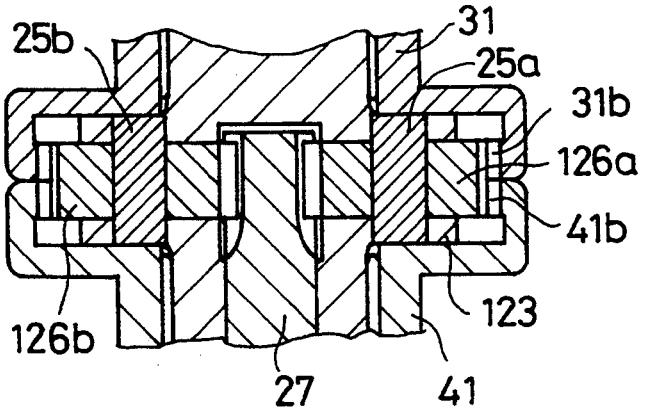
FIG. 8 is a cross-sectional view taken along line VIII—VIII of FIG. 7.

However, the positional relationship of these axes is not limited to the above configuration. For example, as shown in FIGS. 7 and 8, first and second planetary pinions 126*a*, 126*b* may be aligned in a direction which is normal to the direction in which the axes C2, C4 of the left and right crankpins are radially displaced off-center. That is, a plane passing through the centers of the first and second planetary pinions 126*a*, 126*b* and the axis C1 of the main shaft 10, and a plane passing through the axes C2, C4 of the left and right crankpins and the axis C1 of the main shaft 10 may extend perpendicularly to each other. In this arrangement, the internal ring gears 31*b*, 41*b* and the planetary pinions 126*a*, 126*b* mesh with each other at two points, respectively, resulting in an increase in the mechanical strength.

While the main shaft 10 rotates in the above embodiment, the main shaft 10 may be fixed, and the cylinders and plungers may rotate about the main shaft.

If the main shaft 10 rotates, then it is necessary to rotate the stroke adjusting shaft 27 together with the main shaft 10, and hence to position the stroke adjusting shaft 27 at the center of the main shaft 10. If the main shaft 10 is fixed, however, the stroke adjusting shaft may be positioned eccentrically with respect to the main shaft insofar as the stroke adjusting shaft is rotatable itself. With such a modification, the stroke adjusting shaft 27 may be positioned and have a desired diameter with greater freedom without impairing the mechanical strength of the crankpins.

Figure 9:
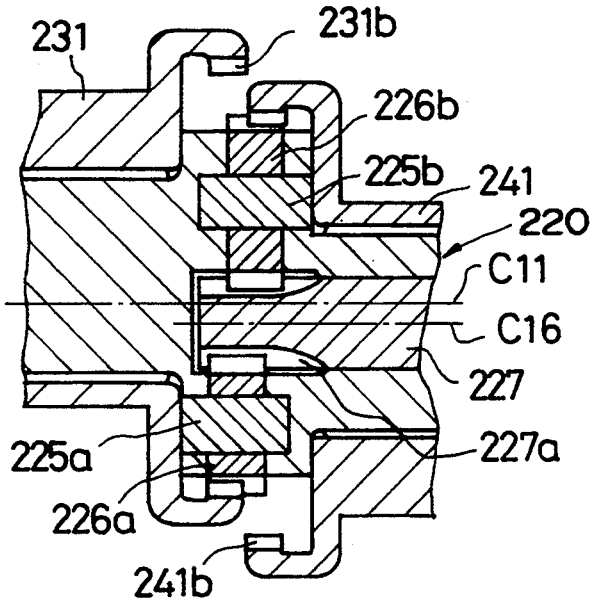
FIG. 9 is a cross-sectional view of still another stroke adjusting mechanism.

For example, as shown in FIG. 9, a stroke adjusting shaft 227 may be disposed such that its central axis C16 is displaced off the central axis C11 of a double crankshaft 220, i.e., a main shaft. In this arrangement, the diameter of a first planetary pinion 226*a* rotatably supported on a pin 225*a* may be reduced, and the diameter of a second planetary pinion 226*b* rotatably supported on a pin 225*b* may be increased.

If the numbers of teeth of first and second internal ring gears 231*b*, 241*b* are equal to each other, then upon rotation of the stroke adjusting shaft 227, eccentric collars 231, 241 are rotated through equal angles for adjusting the strokes of the left and right arrays of plungers to the same value.

Figure 10:
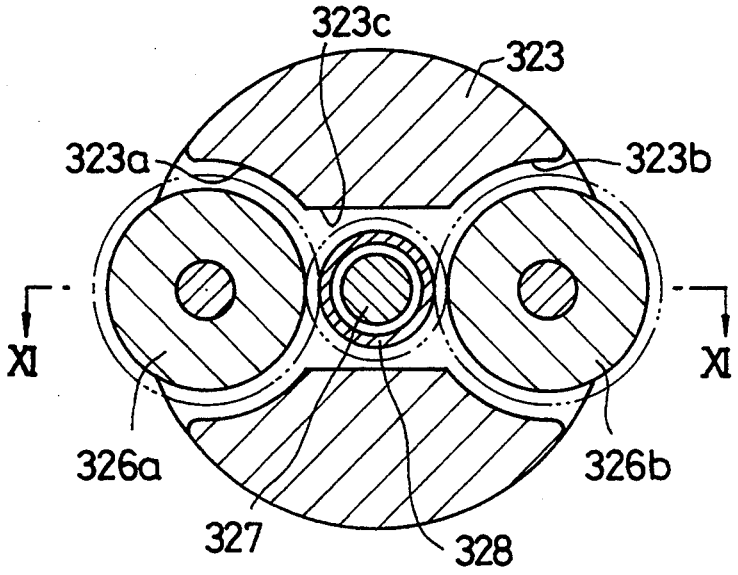
FIG. 10 is a cross-sectional view of a further stroke adjusting mechanism.
Figure 11:
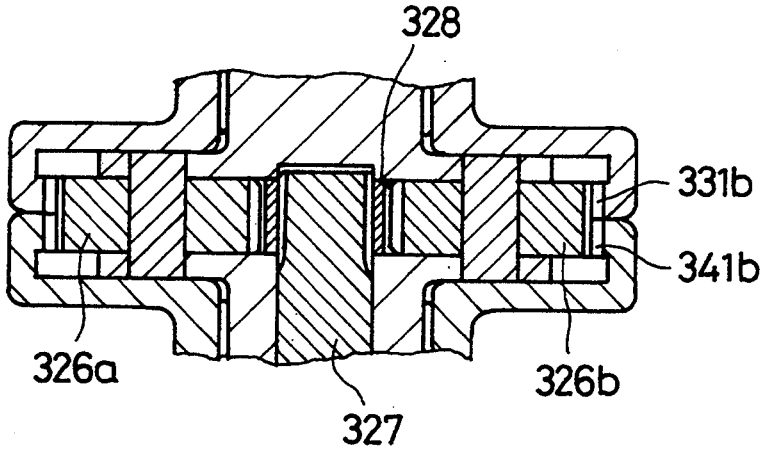
FIG. 11 is a cross-sectional view taken along line XI—XI of FIG. 10.

Alternatively, as shown in FIGS. 10 and 11, gear insertion spaces 323*a*, 323*b* defined in a web 323 of a double crankshaft and housing first and second planetary pinions 326*a*, 326*b*, respectively, may be joined to each other by a gear insertion space 323*c* defined in the web 323, and a sum gear 328 may be disposed in the gear insertion space 323*c*. The sun gear 328 may be splined to the distal end of the stroke adjusting shaft 327. This modification allows a gear ratio to be selected with greater freedom.

Figure 12:
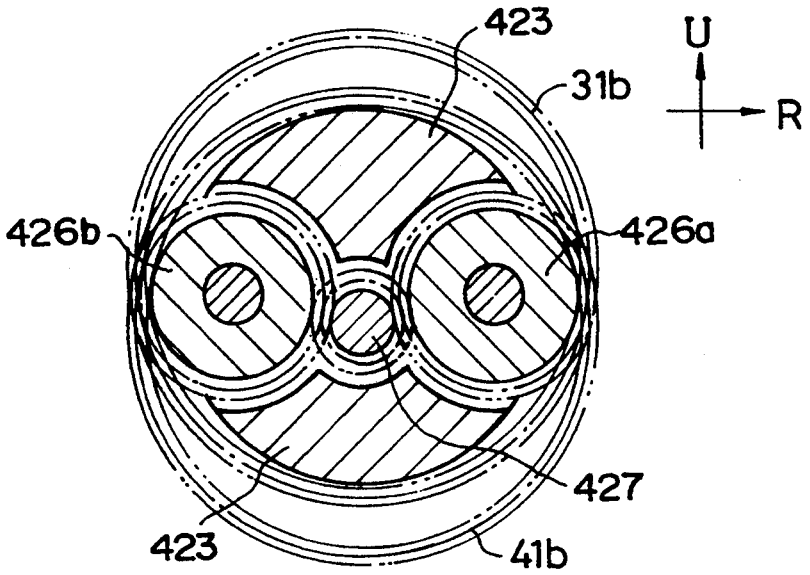
FIG. 12 is a cross-sectional view of a still further stroke adjusting mechanism.

FIG. 12 shows a still further stroke adjusting mechanism which is a combination of the arrangement shown in FIGS. 7 and 8 and the arrangement shown in FIG. 9. In the structure shown in FIG. 12, a double crankshaft (main shaft) is fixed, and a stroke adjusting shaft 427 has a central axis offset from the central axis of the double crankshaft. First and second planetary pinions 426*a*, 426*b* disposed in a web 423 are aligned in a direction normal to the direction in which the axes of the left and right crankpins are radially displaced off-center. In this arrangement, the internal ring gears 31*b*, 41*b* and the planetary pinions 426*a*, 426*b* mesh with each other at two points, respectively, resulting in an increase in the mechanical strength. The stroke adjusting shaft 427 may be positioned and have a desired diameter with greater freedom without impairing the mechanical strength of the crankpins.

A radial valve mechanism for use in a radial-plunger hydraulic pump, motor, or the like of the structure described above now will be described.

Figure 22:
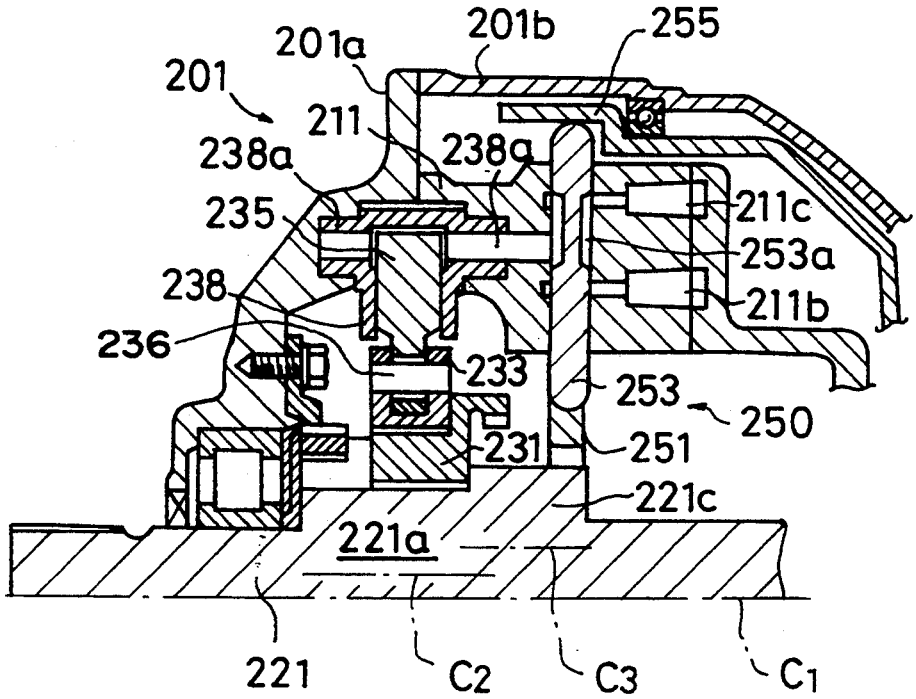
Fig. 22 PRIOR ART
FIG. 22 is a sectional side-elevational view of a plunger-type hydraulic pump with a conventional radial valve mechanism.
Figure 23:
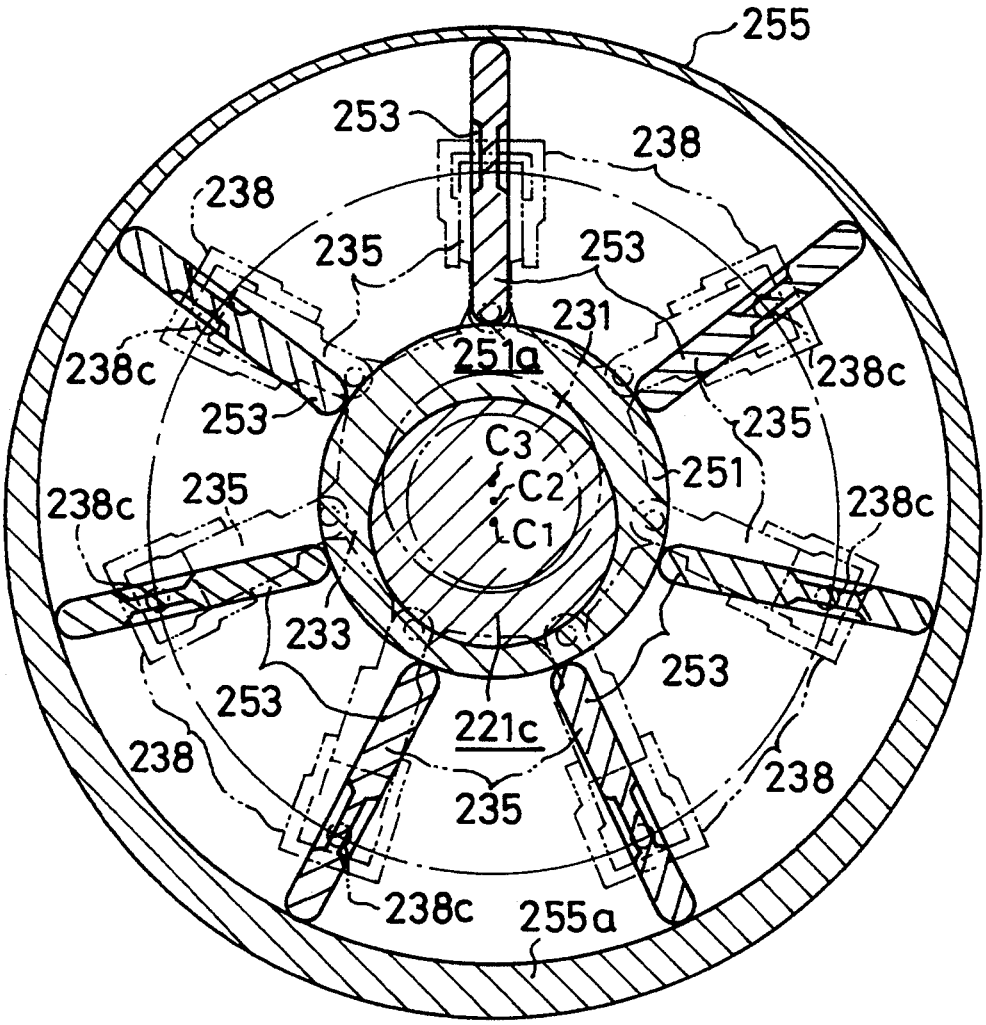
Fig. 23 PRIOR ART
FIG. 23 is a cross-sectional view of the conventional radial valve mechanism.

As shown in FIGS. 22 and 23, a radial valve mechanism is used as part of a radial-plunger pump or motor unit, for example. The unit, generally denoted at 201, comprises a casing 211 fixedly housed in housings 201*a*, 201*b*, and a main shaft 221 disposed centrally in the housings 201*a*, 201*b*. The main shaft 221 is rotatable about an axis C1 relative to the casing 211, and has on its longitudinal intermediate region an eccentric portion 221*a* having a central axis C2 radially displaced from the axis C1 and a larger-diameter portion 221*c* having a central axis aligned with the central axis C1. When the main shaft 211 rotates, the axis C2 of the eccentric portion 221*a* revolves around the axis C1.

A connecting ring 233 is relatively rotatably mounted on the eccentric portion 221*a* by a bearing and an eccentric collar 231 whose axis is radially displaced out of alignment with the axis C2. Seven plungers 235 that are circumferentially equally spaced are swingably coupled to the outer circumference of each of the connecting rings 233 by pins 236, and seven cylinders 238 that are circumferentially equally spaced about the axis C1 are disposed radially outwardly of the eccentric portion 221*a*. As shown in FIG. 22, each of the cylinders 238 is rockably supported in the housing 201*a* and the casing 211 by left and right trunnions 238*a*. The plungers 235 are slidably inserted in the respective cylinders 238. The trunnions 238*a* have respective fluid passages 238*c* connected to radially inner and outer fluid passages 211*b*, 211*c* that are defined in the casing 211.

The radial valve mechanism, generally denoted as 250, comprises a substantially annular spool return member 251, and seven spool valves 253 disposed at circumferentially equal intervals and projecting radially outwardly around the axis C1. The spool valves 253 are radially reciprocally inserted in the casing 211 between the flow passages 238*c* and the radially inner and outer fluid passages 211*b*, 211*c*. The spool valves 253 have radially inner ends held against the outer circumferential surface of the spool return member 251. The radial valve mechanism 250 also has an annular cam ring 255 disposed radially outwardly of the larger-diameter portion 221*c* in surrounding relationship to the spool valves 253. The cam ring 255 has a radially inner cam surface having a single cam lobe 255*a* against which the radially outer ends of the spool valves 253 are held.

The cam ring 255 can be rotated about the axis C1 with respect to the casing 211 at the same speed as the main shaft 221 by a drive mechanism (not shown). Upon rotation of the cam ring 255, the spool valves 253 are radially reciprocally moved successively to bring the flow passages 238*c* into and out of communication with the radially inner fluid passage 211*b* or radially outer fluid passage 211*c* through communication grooves 253*a* defined in intermediate portions of the spool valves 253.

When the unit 201 of the above construction is used as a hydraulic pump, the housings 201*a*, 201*b* and the casing 211 are fixed in position, and the main shaft 221 is rotated to cause the axis C2 of the eccentric portion 221*a* to revolve around the axis C1. Since the connecting ring 233 also revolves around the axis C1, the plungers 235 move back and in forth in the respective cylinders 238.

At the same time, the cam ring 255 rotates about its own axis at the same speed as the main shaft 221. When the spool valves 253 are pushed radially inwardly by the cam lobe 255*a* of the rotating cam ring 255, the fluid passages 238*c* are brought into communication with the radially inner fluid passage 211*b*, and out of communication with the radially outer fluid passage 211*c*. Since the plungers 235 are moving toward the bottom dead center at this time, oil under pressure is drawn into the cylinders 238 from the radially inner fluid passage 211*b* and the fluid passages 238*c*. When the spool valves 253 are pushed radially outwardly by the spool return member 251, the fluid passages 238*c* are brought into communication with the radially outer fluid passage 211*c*, and out of communication with the radially inner fluid passage 211*b*. Since the plungers 235 are moving toward the top dead center at this time, oil under pressure is discharged from the cylinders 238 through the fluid passages 238*c* and the radially outer fluid passage 211*c*.

If the supply of oil into and discharge of oil from the cylinders 238 is controlled to rotate the main shaft 221, then the unit 201 operates as a hydraulic motor.

The unit 201 may operate as a hydraulic pump or motor with the main shaft 221 being fixed against rotation. In this case, the casing 211 and the cylinders 238 are rotated. Since the plungers 235 are coupled to the connecting ring 233, the connecting ring 233 revolves around the axis C2 of the eccentric portion 221*a* at the same speed as the cylinders 238 in response to rotation of the casing 211 and the cylinders 238. The plungers 235 now move back and forth in the respective cylinders 238 for supplying and discharging oil under pressure.

To actuate the cam ring 255, the radial valve mechanism consumes power (an amount of work) that is expressed by;

$$W=\mu FV \quad (4)$$

where $\mu$: the coefficient of friction between the spool valves and the cam ring;

F: the force with which the cam ring pushes the spool valves; and

V: the speed at which the cam ring slides with respect to the spool valves.

Therefore, when the cam ring and the main shaft rotate at the same speed as described above, a considerably large power is consumed, and wear or seizure due to excessive heating tends to occur between sliding surfaces of the cam surface of the cam ring and the spool valves.

A hydraulic pump or motor which has a radial valve mechanism capable of reducing the consumption of a power required to rotate the cam ring now will be described.

Figure 13:
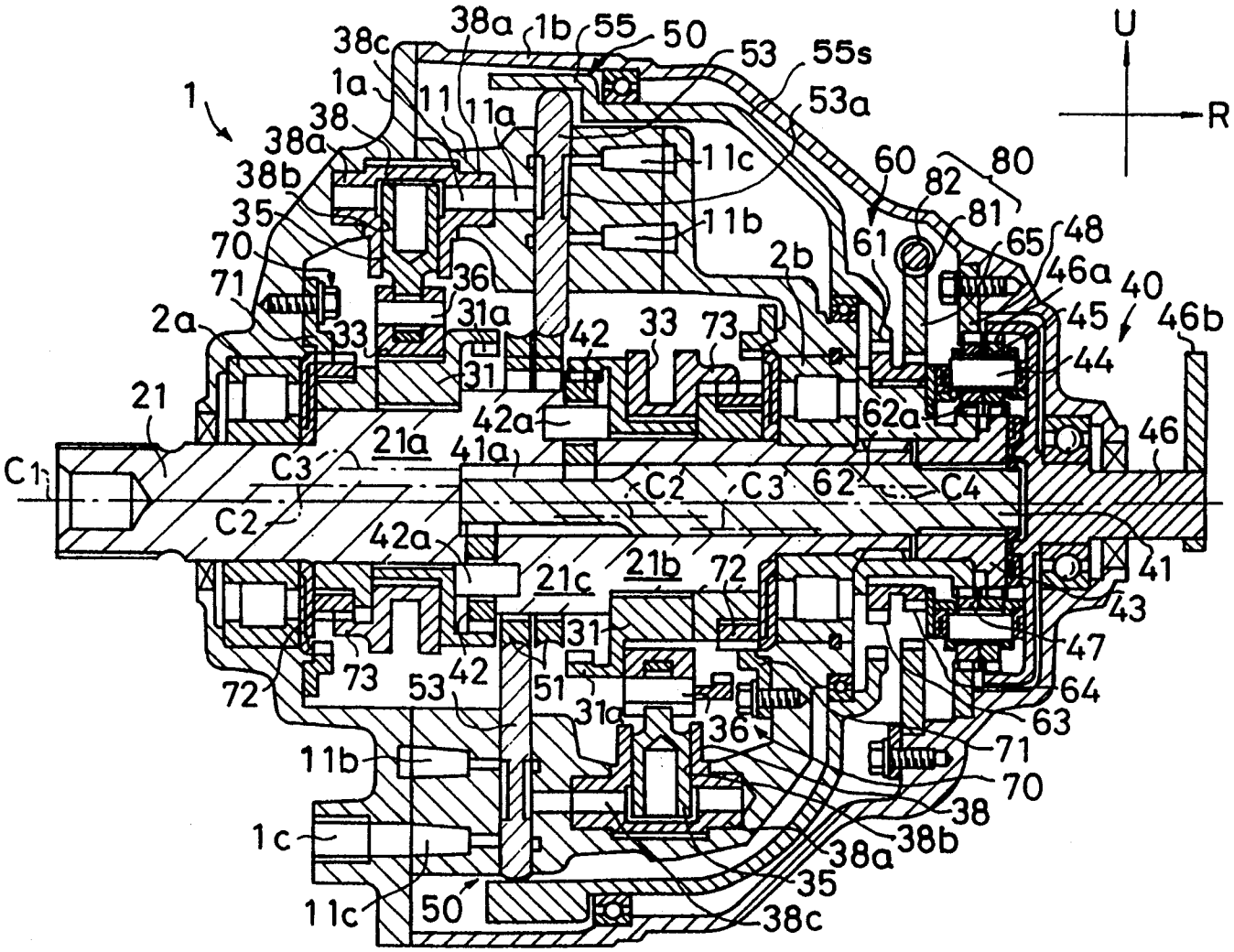
FIG. 13 is a sectional side-elevational view of a second embodiment of a plunger-type hydraulic pump having a radial valve mechanism.

FIG. 13 shows a hydraulic pump 1 having such a radial valve mechanism. In FIG. 13, the hydraulic pump 1 has its main shaft extending horizontally, and the arrows U and R indicate upward and rightward directions with respect to the hydraulic pump 1.

The hydraulic pump 1 has a casing 11 disposed in two, i.e., left and right, separable housings 1*a*, 1*b*, and a main shaft 21 rotatably supported by bearings 2*a*, 2*b* vertically centrally in the casing 11 for rotation with respect to the housings 1*a*, 1*b*. The main shaft 21 is rotatable about its central axis C1. The main shaft 21 has a left end projecting out of the left housing 1*a* for connection to an external actuator to rotate the main shaft 21.

The main shaft 21 has eccentric portions 21*a*, 21*b* respectively on its left end and intermediate region in the casing 11. The eccentric portions 21*a*, 21*b* have respective central axes C2, C2′ radially displaced from the axis C1 and angularly spaced from each other by 180° across the axis C1. Eccentric collars 31 are angularly movably mounted on the respective eccentric portions 21*a*, 21*b*, the eccentric collars 31 having respective central axes C3, C3′ radially displaced from the respective axes C2, C2′.

Figure 14:
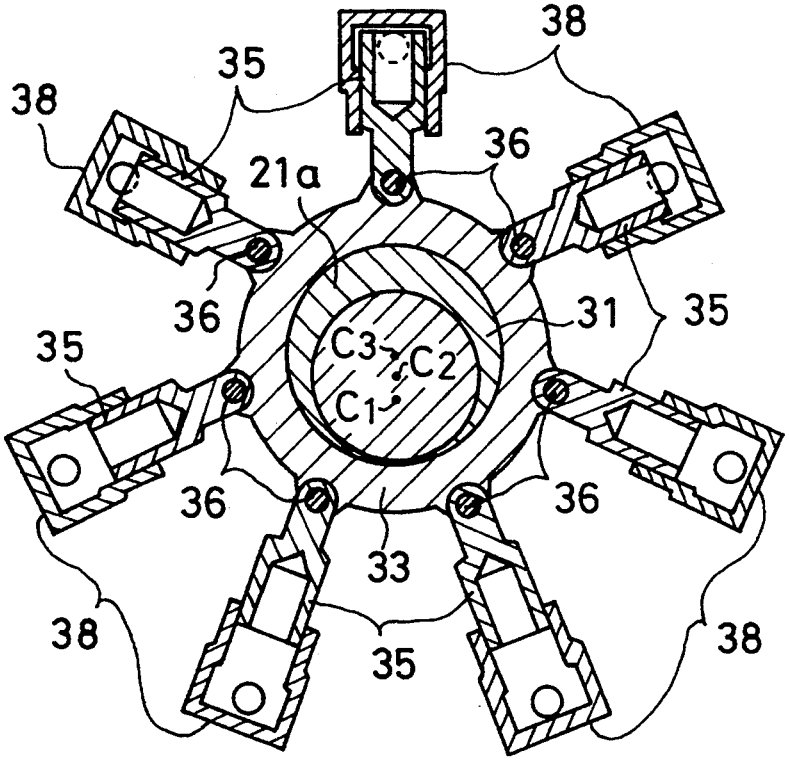
FIG. 14 is a cross-sectional view of cylinders of the plunger-type hydraulic pump shown in FIG. 13.

Connecting rings 33 are relatively rotatably mounted on the eccentric collars 31, respectively, by bearings. Therefore, the connecting rings 33 are rotatable on the respective eccentric collars 31 about the respective axes C3, C3′. As shown in FIG. 14, seven plungers 35 that are circumferentially equally spaced are swingably coupled by pins 36 to each of the connecting rings 33 for swinging movement in the circumferential direction, and seven cylinders 38 that are circumferentially equally spaced are disposed around each of the eccentric collars 31 in the casing 11. As shown in FIG. 13, each of the cylinders 38 has a pair of left and right trunnions 38*a*, and is circumferentially rockably mounted in the left housing la and the casing 11 by the trunnions 38*a*. The plungers 35 are slidably inserted in respective cylinder bores 38*b* defined in the respective cylinders 38.

The trunnions 38*a* have respective fluid passages 38*c* connected to the cylinder bores 38*b* and opening at left and right ends of the trunnions 38*a*.

The casing 11 has fluid passages 11*a* defined in radially intermediate portions thereof near the cylinders and connected to the fluid passages 38*c*, and radially inner and outer fluid passages 11*b*, 11*c* defined in radially inner and outer portions thereof remote from the cylinders. The radially inner fluid passages 11*b* are connected to an external oil tank (not shown), and the radially outer fluid passages 11*c* are connected to hydraulic pressure discharge ports 1*c* (only one defined in the left housing la is shown in FIG. 13).

Figure 15:
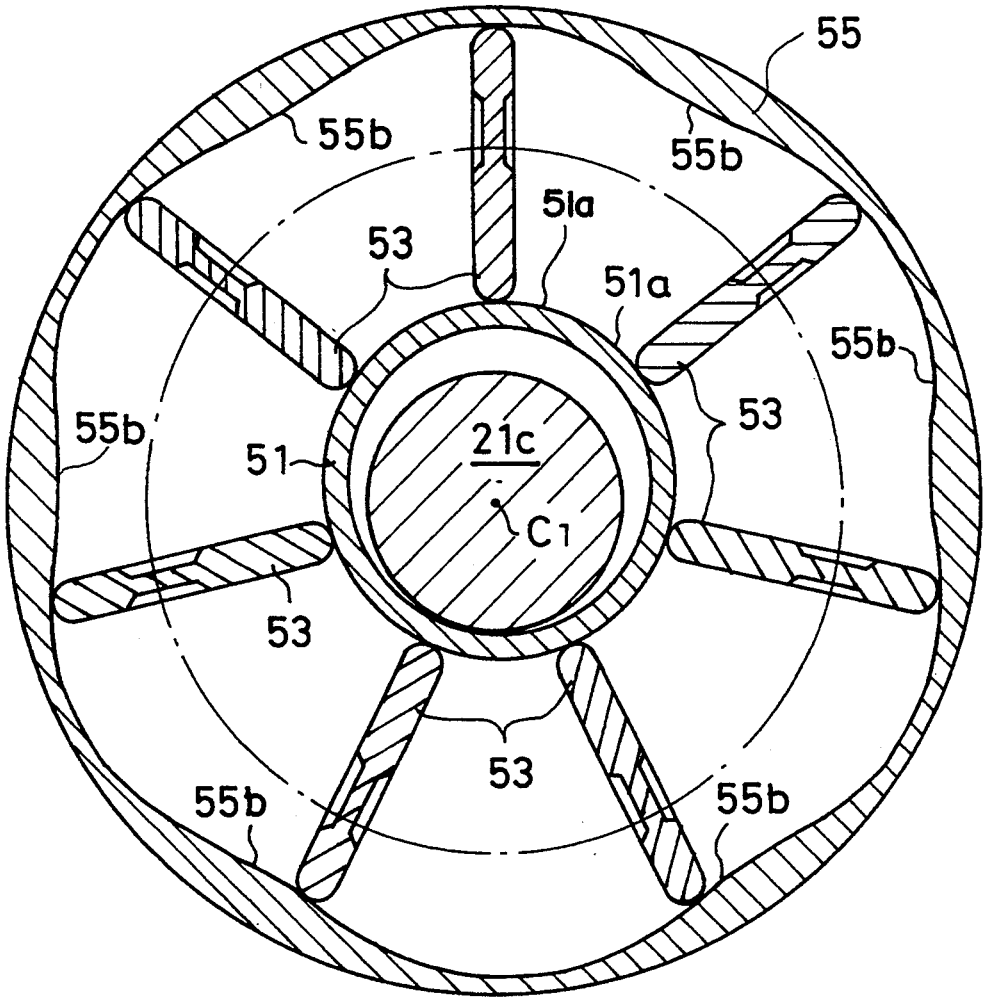
FIG. 15 is a cross-sectional view of the radial valve mechanism.

The main shaft 21 has a larger-diameter portion 21*c* formed between the eccentric portions 21*a*, 21*b* and having its central axis aligned with the axis C1. Two radial valve mechanisms 50 are disposed around the larger-diameter portion 21*c*. The radial valve mechanisms 50 are disposed side by side at the larger-diameter portion 21*c*. As shown in FIG. 15, the radial valve mechanisms 50 have respective spool return rings 51 each having a circular outer circumferential surface 51*a* as shown in FIG. 15, and respective arrays of seven (N) spool valves 53 disposed around the respective spool return rings 51 and circumferentially equally spaced and radially disposed around the axis C1. Each of the spool return rings 51 has an inside diameter larger than the outside diameter of the larger-diameter portion 21*c*, so that the spool return rings 51 can be radially displaced off-center from the larger-diameter portion 21*c* (axis C1) by a distance corresponding to the difference between the above inside and outside diameters. The spool valves 53 have radially inner ends held against the outer circumferential surfaces 51*a* of the spool return rings 51. The spool valves 53 can be pushed radially outwardly with respect to the casing 11 by the outer circumferential surfaces 51*a* of the spool return rings 51 which are off-center from the larger-diameter portion 21*c*.

An annular cam ring 55 is disposed around the parallel arrays of the spool valves 53. The cam ring 55 has a cam surface on its inner circumferential surface which has six (N−1) cam lobes 55*b* that are circumferentially equally spaced. The radially outer ends of the spool valves 53 are held against these cam lobes 55*b*. When pushed by the cam lobes 55*b*, the spool valves 53 are moved radially inwardly with respect to the casing 1 while displacing the spool return ring 51 radially away from the cam lobes 55*b*.

The spool valves 53 have communication grooves 53*a* defined in their intermediate portions. When the spool valves 53 are moved radially inwardly, the communication grooves 53*a* bring the radially inner fluid passages 11*b* into communication with the fluid passages 11*a*, i.e., the fluid passages 38*c*, and the radially outer fluid passages 11*b* out of communication with the fluid passages 11*a*. Upon radially inward movement of the spool valves 53, the plungers 35 in the corresponding cylinders 38 move toward their bottom dead center. These cylinders 38 are therefore supplied with oil under pressure from the radially inner fluid passages 11*b*, the fluid passages 11*c*, and the fluid passages 38*c*.

When the spool valves 53 are moved radially outwardly, the communication grooves 53*a* bring the radially outer fluid passages 11*c* into communication with the fluid passages 11*a*, and the radially inner fluid passages 11*b* out of communication with the fluid passages 11*a*. Upon radially outward movement of the spool valves 53, the plungers 35 in the corresponding cylinders 38 move toward their top dead center. Now, oil is discharged under pressure from these cylinders 38 through the fluid passages 38*c*, the fluid passages 11*a*, and the radially outer fluid passages 11*c*, and flows out of the device through the discharge ports 1*c*.

Upon such rotation of the cam ring 55 in coaction with the spool return ring 51, the spool valves 53 are successively reciprocally moved to supply oil into and discharge oil from the cylinders 38. The radial valve mechanism 50 has a cam drive mechanism 60 for actuating the cam ring 55. The cam drive mechanism 60 will now be described below.

Figure 16:
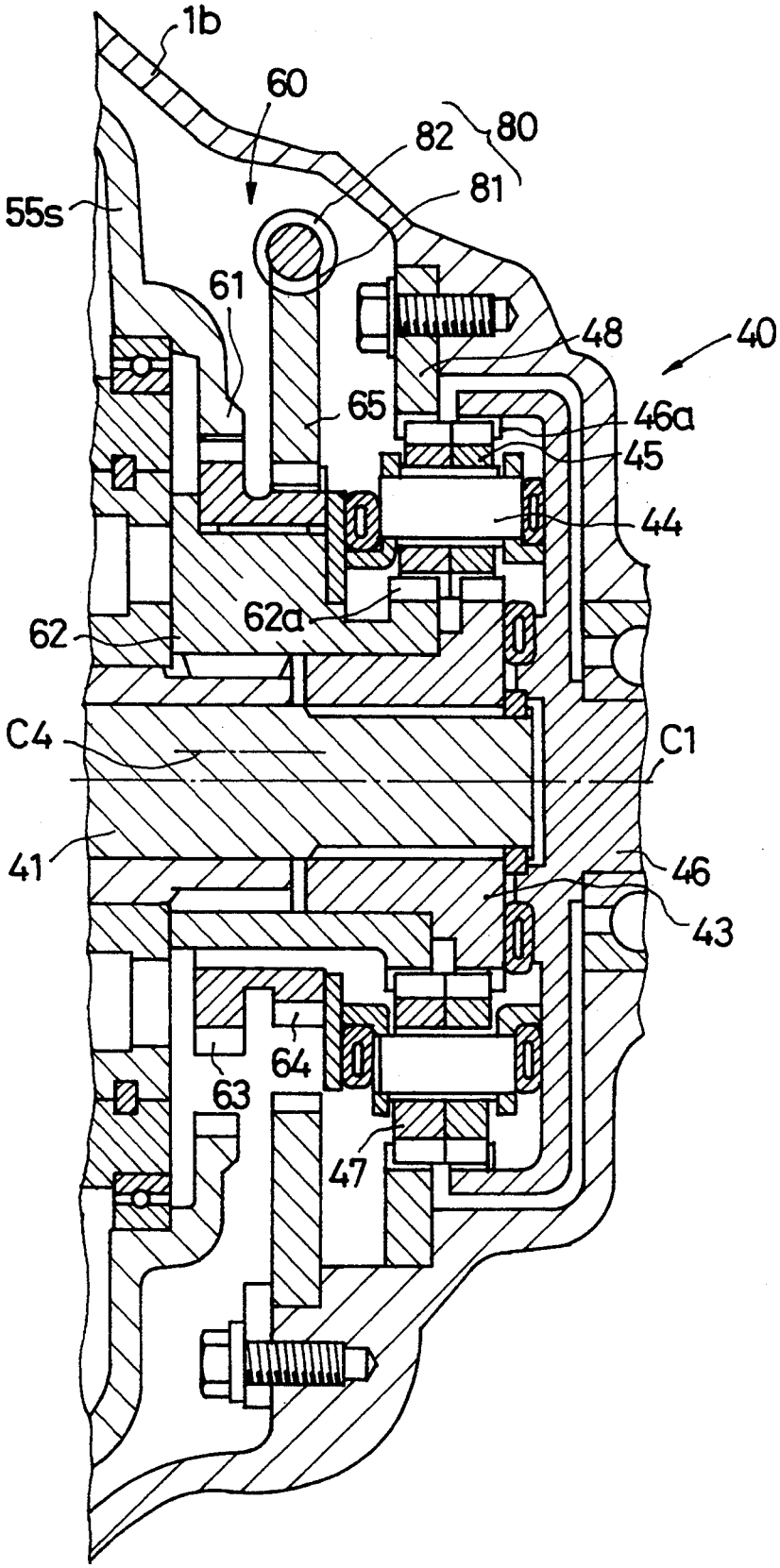
FIG. 16 is an enlarged cross-sectional view of a cam drive mechanism in the radial valve mechanism.

As shown at enlarged scale in FIG. 16, the cam drive mechanism 60 comprises a first internal gear 61 integrally formed with a right end of a skirt 55*s* that extends to the right from a right end of the cam ring 55. The first internal gear 61 is rotatably supported by the right housing 1*b* and the casing 11 for rotation about the axis C1 of the main shaft 21. An eccentric ring 62 is mounted on a right end of the main shaft 21 and has a central axis C4 radially displaced off the axis C1. A first external gear 63 is rotatably mounted on the eccentric ring 62. The first external gear 63 is in mesh with the first internal gear 61. The first external gear 63 is integral with a second external gear 64 having a central axis aligned with the axis C4. A second internal gear 65 is fixedly positioned in the housing 1*b* and has a central axis aligned with the axis C1. The second internal gear 65 is in mesh with the second external gear 64.

The number Zb of teeth of the first external gear 63 is smaller than the number Za of teeth of the first internal gear 61, and the number Zd of teeth of the second internal gear 65 is larger than the number Zc of teeth of the second external gear 64. The number Zc of teeth of the second external gear 64 is larger than the number Zb of teeth of the first external gear 63. These numbers of teeth are selected to satisfy the following equation:

$$(Zb\times Zd)/(Za\times Zc)=N/(N-1)=(7/6) \quad (5).$$

Therefore, when the main shaft 21 makes one revolution and the axis C4 goes around the axis C1 once, the first external gear 63 rotates in the direction opposite to that in which the main shaft 21 rotates (Zd/Zc)−1 times. The first external gear 61 rotates with the second external gear 63 as they are integral with each other. Since their numbers of teeth are different from each other, the first internal gear 61, i.e., the cam ring 55, rotates a number of times that is expressed by:

$$\{(Zd/Zc)-1\}\times Zb/Za+(Zb/Za)-1 \quad (6).$$

Figure 17:
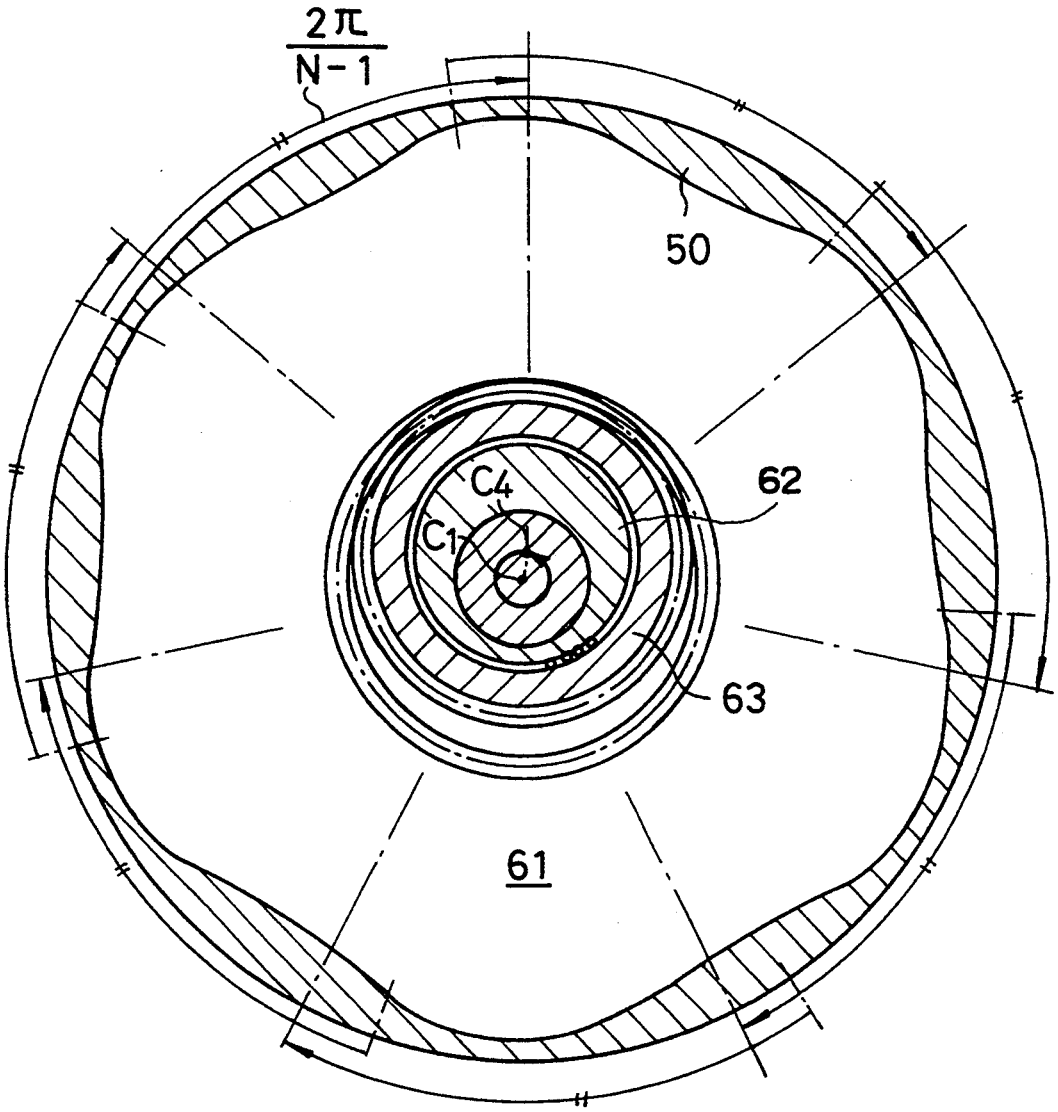
FIG. 17 is a cross-sectional view of the radial valve mechanism.

If the equation (5) is substituted in the equation (6), then it can be understood that the cam shaft 55 rotates 1/(N−1) times while the main shaft 21 makes one revolution, as shown in FIG. 17.

When the cam ring 55 rotates 1/(N−1) times, i.e., for an angular interval of $2\pi/(N-1)$, the cam lobes 55*b* move past the positions of all the spool valves 53. Therefore, the spool valves 53 are successively reciprocally moved once for supplying oil into and discharging oil from the cylinders 38.

As the rotational speed of the cam ring 55, i.e., the speed of the cam ring 55 as it slides on the spool valves 53, is 1/(N−1) of the rotational speed of the main shaft 21, the power (amount of work) that is consumed to drive the cam ring 55 is reduced. Inasmuch as the speed at which the spool valves 53 slide against the cam surface 55*a* of the cam ring 55 is low, any wear or seizure between the sliding surfaces of the spool valves 53 and the cam ring 55 is also low.

In the above embodiment, the cam ring has (N−1) cam lobes, and rotates 1/(N−1) times in the opposite direction to the main shaft while the main shaft makes one revolution. However, the cam ring may have more cam lobes. More specifically, the cam ring may have n×N−1 (n=2, 3, 4, . . . ) cam lobes, and the numbers of teeth of the gears may be selected to satisfy the following equation:

$$(Zb\times Zd)/(Za\times Zc)=n\times N/(n\times N-1) \quad (7).$$

Figure 18:
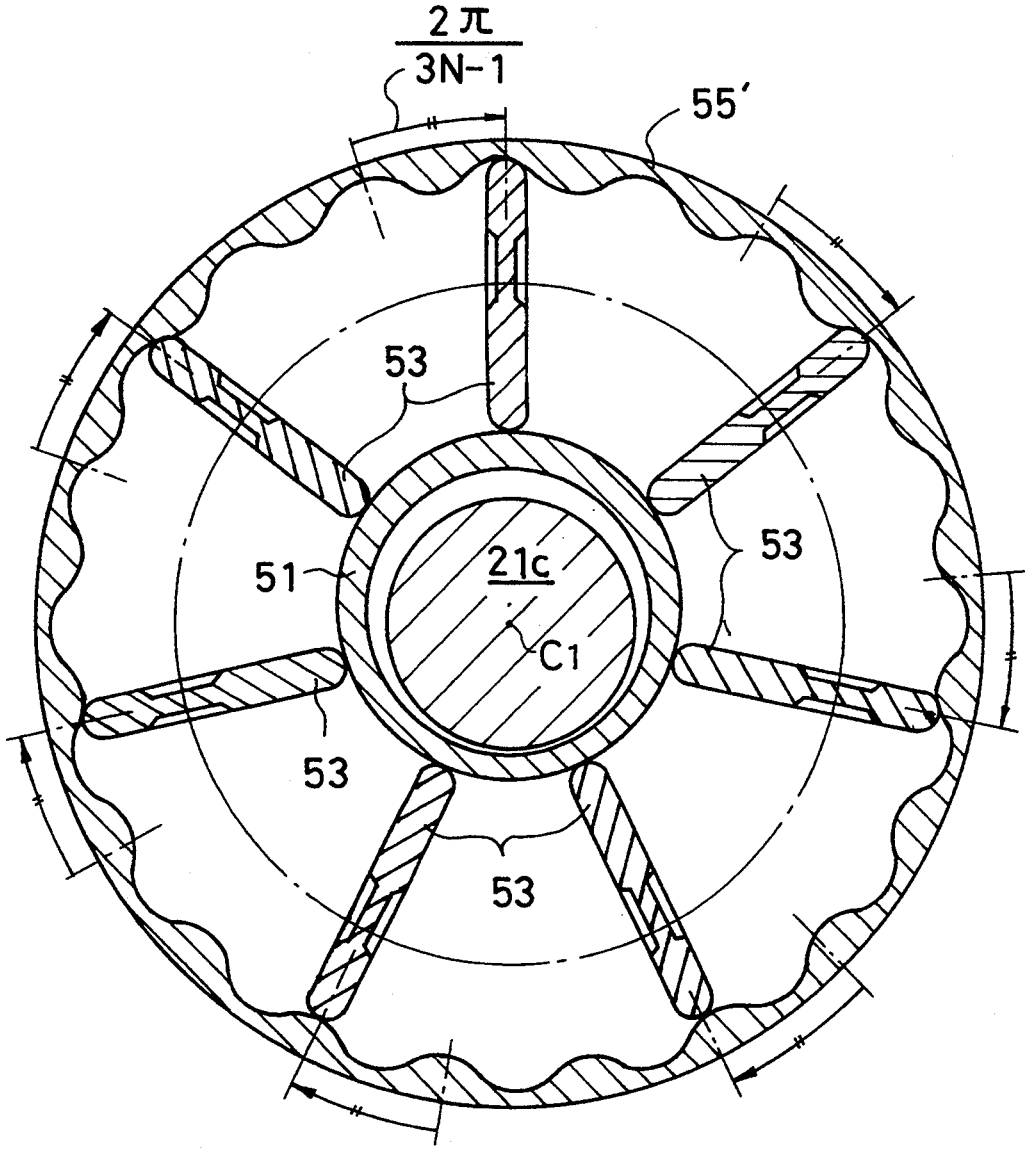
FIG. 18 is a cross-sectional view of the radial valve mechanism.

FIG. 18 shows a cam ring 55' where n=3. The cam ring rotates 1/(n×N−1) times in the opposite direction to the main shaft while the main shaft makes one revolution, and the spool valves 53 are successively reciprocally moved once. However, the angle through which the cam ring rotates is smaller than the angle in the above embodiment (n=1). Therefore, any wear or seizure between the sliding surfaces of the spool valves and the cam ring is much lower.

In the above embodiment, the cam ring rotates in the opposite direction to the main shaft. However, the cam ring may rotate in the same direction as the main shaft. In such a modification, the cam ring may have n×N+1 (n=1, 2, 3, 4, . . . ) cam lobes, and the numbers of teeth of the gears may be selected to satisfy the following equation:

$$(Zb\times Zd)/(Za\times Zc)=n\times N/(n\times N+1) \quad (8).$$

The cam ring now rotates 1/(N+1) times in the same direction as the main shaft while the main shaft makes one revolution. This arrangement also offers the same advantages as the above arrangement in which the cam ring rotates in the opposite direction to the main shaft.

Figure 19:
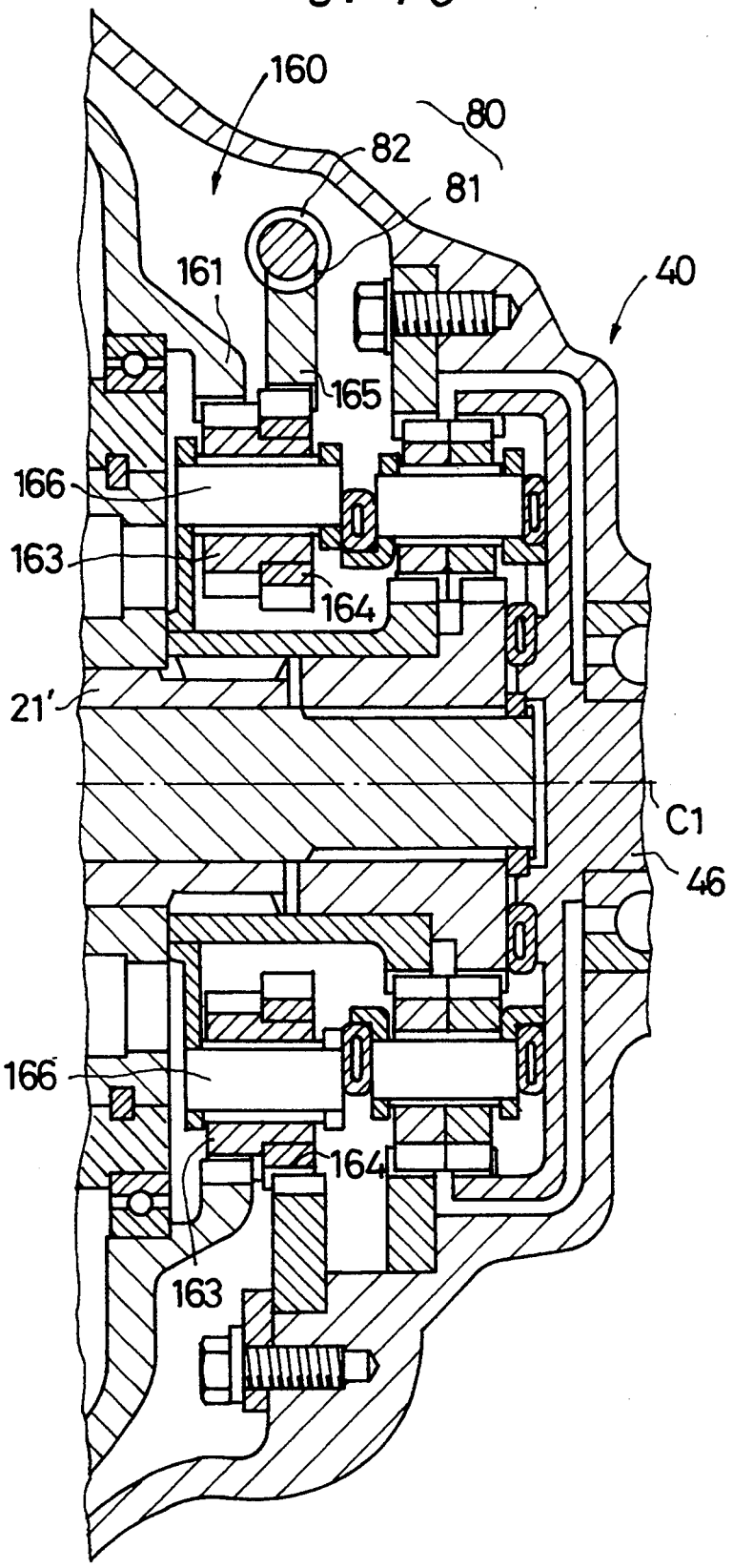
FIG. 19 is an enlarged cross-sectional view of a cam drive mechanism according to another embodiment of the present invention.

As shown in FIG. 19, the first and second external gears 163, 164 of the cam drive mechanism 160 may be in the form of planet gears mounted on a carrier 166 whose axis is displaced off the axis C1 so that the first and second external gears 163, 164 can revolve around the main shaft 21. This planet gear design is effective to reduce designing limitations which would otherwise tend to occur due to meshing between the internal and external gears.

As shown in FIGS. 13 and 16, the hydraulic pump 1 has a stroke adjusting mechanism 40 for adjusting the stroke of reciprocating motion of the plungers 35 to control the amount of oil discharged from the discharge ports 1*c*. More specifically, a stroke adjusting shaft 41 having a central axis aligned with the axis C1 is inserted from the right end of the main shaft 21 to the larger-diameter portion 21*c* thereof, the stroke adjusting shaft 41 being angularly movable with respect to the main shaft 21. The stroke adjusting shaft 41 has an external gear 41*a* on its left end that is positioned in the intermediate portion of the main shaft 21. The external gear 41*a* is held in mesh with two external gears 42 disposed in gear insertion spaces defined in left and right portions of the larger-diameter portion 21*c*, the external gears 42 being rotatably supported in the gear insertion spaces by respective pins 42*a*. The external gears 42 are also held in mesh with respective internal gears 31*a* of the eccentric collars 31.

A first sun gear 43 is splined to a right end of the stroke adjusting shaft 41. The first sun gear 43 is held in mesh with first planetary gears 45 rotatably mounted on carrier pins 44. The first planetary gears 45 are held in mesh with a first ring gear 46*a* integral with a left end of a drive shaft 46 having an end portion projecting out of a right end of the right housing 1*b*. The eccentric ring 62 has a second sun gear 62*a* on its right end, the second sun gear 62*a* having the same number of teeth as the first sun gear 43. The second sun gear 62*a* is held in mesh with second planetary gears 47 that are rotatably mounted on the carrier pins 44 independently of the first planetary gears 45. The second planetary gears 47 are held in mesh with a second ring gear 48 that is fixed to an inner wall of the right housing 11*b* by bolts and has the same number of teeth as the first ring gear 46*a*. A lever 46*b* is attached to a right end of the projecting end portion of the drive shaft 46, and a lever swinging device (not shown) is coupled to the lever 46*b*.

When the main shaft 21 rotates while the drive shaft 46 is fixed by the lever swinging device, the second planetary gears 47 are rotated by the second sun gear 62*a* which rotates in unison with the main shaft 21. Since the second ring gear 48 is fastened to the right housing 1*b*, the carrier pins 44 rotate in the same direction as the second sun gear 62*a*. The first planetary gears 45 now rotate at the same speed as the second planetary gears 47, rotating the first sun gear 43, i.e., the stroke adjusting shaft 41, in the same direction and at the same speed as the main shaft 21.

When the drive shaft 46 is angularly moved by the lever swinging device while the main shaft 21 is being fixed against rotation, the rotation of the first ring gear 46*a* is transmitted through the first planetary gears 45 to the first sun gear 43. At this time, the carrier pins 44 are not rotated, and the stroke adjusting shaft 41 is rotated with respect to the main shaft 21 by the first planetary gears 45. The rotation of the stroke adjusting shaft 41 is transmitted through the external gear 42 to the internal gear 31*a*, causing the eccentric collars 31 to turn with respect to the main shaft 21 and the connecting rings 33.

The angular movement of the eccentric collars 31 adjusts the stroke of the reciprocating movement of the plungers 35. Such stroke adjustment of the left array of plungers 35 now will be described with reference to FIG. 20.

It is assumed that the eccentric collar 31 is to be angularly moved in a condition in which the axis C1 of the main shaft 21, the axis C2 of the eccentric portion 21*a*, and the central axis C3 of the outer circumferential surface 31*b* of the eccentric collar 31, i.e., the central axis of the connecting ring 33, are linearly aligned with each other. The axis C2 is radially spaced from the axis C1 by a distance L1, the axis C3 is radially spaced from the axis C2 by a distance L2, and the axis C3 is radially spaced from the axis C1 by a distance L3.

When the eccentric portion 21*a*, i.e., the main shaft 21, rotates in the condition in which the axes C1, C2, C3 are linearly aligned with each other, the outer circumferential surface 31*b* of the eccentric collar 31 vertically moves along the direction indicated by the arrow P by a distance 2L3 which is twice the distance L3. Therefore, the connecting ring 33 also vertically moves by the distance 2L3. The reciprocating stroke S of the plungers 35 is determined by the vertical movement of the connecting ring 33. The reciprocating stroke S of the plungers 35 is maximum when the axes C1, C2, C3 are linearly aligned with each other as described above.

Figure 20:
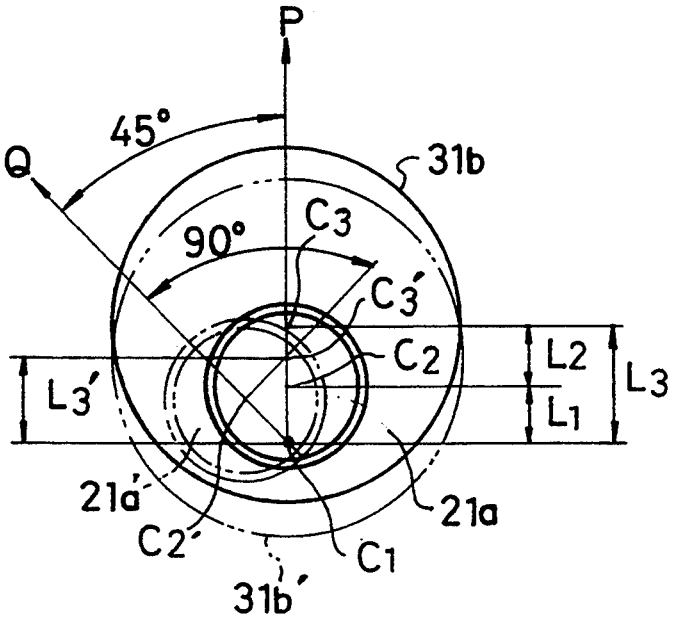
FIG. 20 is a diagram showing the manner in which a stroke adjusting mechanism in the plunger-type hydraulic pump operates.

Now, the eccentric collar 31 is turned from the solid-line position to the two-dot-and-dash-line position in FIG. 20. To keep the center C3 of the outer circumferential surface 31*b* of the eccentric collar 31 aligned with the direction P, the main shaft 21 is turned 45° counterclockwise, and the eccentric collar 31 is turned 90° clockwise on the eccentric portion 21*a*.

The eccentric portion 21*a* moves to a position 21*a*′ with its axis C2 to a position C2′. At the same time, the outer circumferential surface 31*b* of the eccentric collar 31 moves to a position 31*b*′ with its axis C3 to a position C3′. As a result, the axis C3′ of the outer circumferential surface 31*a* of the eccentric collar 31 is spaced from the axis C1 of the main shaft 20 by a distance L3′ (<L3).

When the main shaft 21 then rotates, the outer circumferential surface 31*b*′ of the eccentric collar 31′ vertically moves along the direction P by a distance 2L3′ which is twice the distance L3′. Consequently, the reciprocating stroke S of the plungers 35 is reduced.

While the adjustment of the reciprocating stroke S of the left array of plungers 35 has been described above, the reciprocating stroke S of the right array of plungers 35 can similarly be adjusted by turning the right eccentric collar 31.

The left and right eccentric collars 31 rotate in opposite directions upon rotation of the stroke adjusting shaft 41. However, the right eccentric collar 31 only moves in point-symmetry relationship to the movement shown in FIG. 20. Therefore, the reciprocating stroke of the left and right arrays of plungers 35 can be adjusted in the same manner by rotating the stroke adjusting shaft 41.

In order to reciprocally move the plungers 35 upon rotation of the eccentric collars 31 in unison with the main shaft 21 after the stroke of the plungers 35 has been adjusted, it is necessary to cause the connecting rings 33 to revolve around the main shaft 21, rather than to rotate about their own axes. In this embodiment, double mechanisms 70 are employed to cause the connecting rings 33 to revolve around the main shaft 21.

The connecting rings 33 are associated with respective double mechanisms. The two double mechanisms 70 comprise respective first internal gears 71 fixed to the left housing 1*a* and the casing 11, respectively, by bolts concentrically with the axis C1 of the main shaft 21, respective external gears 72 rotatably mounted on the eccentric portion 21*a*, 21*b*, respectively, concentrically with the axes C2 of the eccentric portions 21*a*, 21*b* and held in mesh with the first internal gears 71, and respective second internal gears 73 integrally formed with the connecting rings 33 concentrically with the axes C3 of the outer circumferential surfaces 31*b* of the respective eccentric collars 31 and held in mesh with the external gears 72, respectively.

The number Z1 of teeth of the first internal gears 71 is equal to the number Z3 of teeth of the second internal gear 73, and the number Z2 of teeth of the external gear 72 is smaller than the numbers Z1, Z3 of teeth of the first and second internal gears 71, 73.

Figure 21:
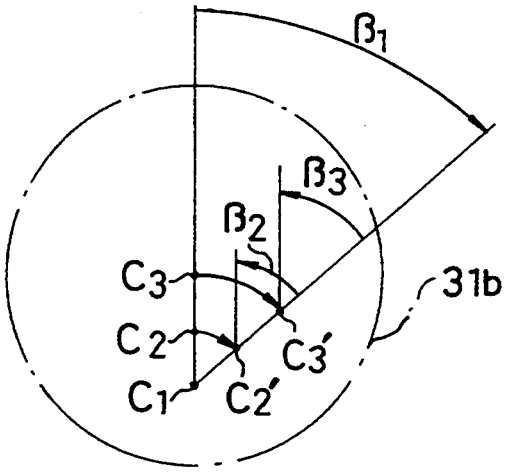
FIG. 21 is a diagram showing the manner in which a double mechanism in the plunger-type hydraulic pump operates.

Operation of the double mechanism 70 associated with the left connecting ring 33 now will be described with reference to FIG. 21.

When the main shaft 21 is rotated, since the eccentric collar 31 is coupled to the main shaft 21 through the stroke adjusting mechanism 60, the axis of the eccentric portion 21*a*, i.e., the axis C2 of the external gear 72, and the axis C3 of the outer circumferential surface 31*b* of the eccentric collar 31 revolve around the axis C1 of the main shaft 21. For example, when the main shaft 21 rotates through an angle $\beta 1$, the axes C2, C3 also rotate about the axis C1 through the angle $\beta 1$.

Inasmuch as the first internal gear 71 is fixed to the left housing 1*a*, when the axis C2 revolves through the angle $\beta 1$, the external gear 72 rotates in the opposite direction through an angle $\beta 2$. Since the numbers of teeth of these gears 71, 72 are inversely proportional to the their rotational angles, the following equation is satisfied:

$$\beta 2 = -Z1/Z2 \times \beta 1 \quad (9).$$

When the external gear 72 rotates through the angle $\beta 2$, the second internal gear 73 rotates through an angle $\beta 3$, which is expressed, using the equation (9), as follows:

$$\beta 3 = Z2/Z3 \times \beta 2 = -Z1/Z3 \times \beta 1 \quad (10).$$

Since a rotational angle (absolute rotational angle) $\beta 4$ of the second internal gear 73 with respect to the first internal gear 71 is equal to the sum of the angles $\beta 1$, $\beta 3$, the rotational angle $\beta 4$ is given by:

$$\beta 4 = (\beta 1 + \beta 3) = (Z3 - Z1)/Z3 \times \beta 1 \quad (11).$$

As can be seen from the equation (11), inasmuch as $Z1 = Z3$, the rotational angle $\beta 4$ of the second internal gear 73 is zero, and the second internal gear 73 does not rotate about its own axis.

Therefore, when the main shaft 21 is rotated with respect to the fixed housings 1*a*, 1*b*, the double mechanism 70 operates as a mechanism for causing the connecting ring 33 to revolve, rather than rotate about its own axis, in response to rotation of the main shaft 21.

The rate at which oil under pressure is discharged from the device is controlled by the stroke adjusting mechanism 60 and the double mechanism 70. As the reciprocating stroke of the plungers 35 is varied, it is necessary to adjust the timing of reciprocating movement of the spool valves 53 in the radial valve mechanism 50.

The radial valve mechanism 50 has a valve timing adjusting mechanism (angularly moving means) 80 as shown in FIGS. 13 and 16. The valve timing adjusting mechanism 80 comprises a worm gear 81 formed on a portion of the outer circumferential surface of the second internal gear 65 of the stroke adjusting mechanism 60, and a worm pinion 82 attached to the right housing 1*b* and meshing with the worm gear 81. In the stroke adjusting mechanism 60, the second internal gear 65 is fixedly positioned in the right housing 1*b* by the meshing engagement between the worm gear 81 and the worm pinion 82 that is held against rotation. When the worm pinion 82 is rotated by a source outside of the device, the second internal gear 65 is angularly moved about the axis C1 of the main shaft 21.

When the second internal gear 65 is turned, the second external gear 64 meshing therewith and the first external gear 63 turn on the eccentric ring 62. The cam ring 55 meshing with the first external gear 63 is now angularly moved about the axis C1. Therefore, the timing of reciprocating movement of the spool valves 53 can be set to an optimum value as the reciprocating stroke of the plungers 35 is varied.

While a hydraulic pump in which a main shaft rotates with respect to a stationary casing has been described above, the radial valve mechanism may be incorporated in a hydraulic pump in which a casing rotates with respect to a stationary main shaft. Such a hydraulic pump may have an angularly moving means for angularly moving a gear, which corresponds to the second internal gear 65 of the cam drive mechanism 60, with respect to the casing about the central axis of the main shaft for adjusting the timing of reciprocating movement of the spool valves.

In the above radial valve mechanism, the speed of the cam ring as it slides on the spool valves is reduced to $1/(n \times N \pm 1)$ of the rotational speed of the main shaft, and all N spool valves reciprocally move while the cam ring rotates $1/(n \times N \pm 1)$ times. Consequently, the power (amount of work) that is consumed to drive the spool valves may be smaller than would be if the cam ring were driven at the same speed as the main shaft, and any wear or seizure between the sliding surfaces of the spool valves and the cam ring is also lower.

The cam drive mechanism may comprise a combination of first and second external gears and first and second internal gears whose numbers of teeth satisfy a certain relationship. Such a simple arrangement is effective to drive the cam ring while reducing the rotational speed of the main shaft.

The first and second external gears of the cam drive mechanism may be in the form of planet gears for solving an interference problem which would otherwise tend to occur due to meshing between the internal and external gears, thus reducing designing limitations.

In the case where an angularly moving means is provided for angularly moving the eccentric shafts (carrier pins in a planetary gear mechanism) of the two external gears of the cam drive mechanism with respect to the main shaft, if the radial valve mechanism is incorporated in a plunger-type hydraulic pump or motor, then the timing of reciprocating movement of the spool valves can be adjusted as the plunger stroke is varied.

Although certain preferred embodiments of the present invention have been shown and described in detail, it should be understood that various changes and modifications may be made therein without departing from the scope of the appended claims.

We claim:

1. A variable-stroke crank mechanism comprising:

a casing;

a crankshaft rotatably supported in said casing for relative rotation about an axis with respect to said casing, said crankshaft having a crankpin displaced out of alignment with said axis;

an eccentric collar rotatably mounted on said crankpin for revolving around said axis in response to the relative rotation of said crankshaft with respect to said casing to reciprocally move an actuator relative to said casing; and a stroke adjusting mechanism for adjusting angular displacement of said eccentric collar on said crankpin;

said stroke adjusting mechanism comprising:

an internal ring gear integral with said eccentric collar concentrically with said crankpin;

a planetary pinion rotatably mounted on said crankshaft and meshing with said internal ring gear;

a sun gear meshing with said planetary pinion; and a stroke adjusting shaft rotatably disposed axially in a portion of said crankshaft and coupled to said sun gear, whereby said stroke adjusting shaft is adjustable in angular displacement to adjust a stroke of reciprocating movement of said actuator.

2. A variable-stroke crank mechanism comprising:

a casing;

a double crankshaft rotatably supported in said casing for relative rotation about an axis with respect to said casing, said double crankshaft having a pair of crankpins displaced out of alignment with said axis, and a web disposed between and integral with said crankpins, said crankpins having respective axes positioned symmetrically with respect to said crankshaft axis;

a pair of eccentric collars rotatably mounted on said crankpins, respectively, for revolving around said crankshaft axis in response to the relative rotation of said double crankshaft with respect to said casing to reciprocally move an actuator relative to said casing; and a stroke adjusting mechanism for adjusting angular displacement of said eccentric collars on said crankpins;

said stroke adjusting mechanism comprising:

a pair of internal ring gears integral with said eccentric collars, respectively, concentrically with the axes of said crankpins, said internal ring gears being positioned around said web;

a pair of planetary pinions rotatably mounted on said web and meshing with said internal ring gears, respectively;

a sun gear rotatably disposed in said web and respect meshing with said planetary pinions; and a stroke adjusting shaft rotatably disposed axially in said crankshaft through one of said crankpins and coupled to said sun gear, whereby said stroke adjusting shaft is controlled in rotation to adjust angular displacement of said eccentric collars to adjust a stroke of reciprocating movement of said actuator.

3. A variable-stroke crank mechanism according to claim 2, wherein said web is positioned axially centrally of said double crankshaft between said crankpins, further comprising a main shaft having a pair of main shaft portions, said crankpins having ends press-fitted in said main shaft portions, respectively, said main shaft being relatively rotatable about said crankshaft axis with respect to said casing.

4. A variable-stroke crank mechanism according to claim 2, wherein said planetary pinions are rotatable about respective axes which are positioned symmetrically with respect to said crankshaft axis, and wherein said crankshaft axis, said axes about which the planetary pinions are rotatable, and said axes of the crankpins are positioned in one plane.

5. A variable-stroke crank mechanism according to claim 2, wherein said planetary pinions are rotatable about respective axes which are positioned symmetrically with respect to said crankshaft axis, and wherein a plane passing through axes about which the planetary pinions are rotatable and said crankshaft axis, and a plane passing through said axis of the crankpins and said crankshaft axis extend perpendicularly to each other.

6. A variable-stroke crank mechanism according to claim 2, wherein said stroke adjusting shaft and said sun gear are disposed eccentrically with respect to said crankshaft axis.

7. A variable-stroke crank mechanism according to claim 2, wherein said sun gear is integrally formed with an end of said stroke adjusting shaft.

8. A variable-stroke crank mechanism according to claim 2, wherein said sun gear is disposed in a gear insertion space defined in said web and coupled to an end of said stroke adjusting shaft in said one of the crankpins.

9. A variable-stroke crank mechanism comprising:

a casing;

a crankshaft rotatably supported in said casing and having a crankpin displaced from an axis of rotation of said crankshaft;

an eccentric collar rotatably mounted on said crankpin for reciprocally moving an actuator relative to said casing;

an internal ring gear connected to said eccentric collar concentrically located with said crankpin;

a planetary gear rotatably mounted on said crankshaft and meshing with said internal ring gear;

a sun gear rotatably mounted on said crankshaft and meshing with said planetary gear; and means for selectively causing angular displacement of said sun gear relative to said crankshaft for adjusting the stroke of the reciprocating movement of said actuator.

10. A variable-stroke crank mechanism according to claim 9, wherein;

said crankshaft has a pair of said crankpins and a web disposed between said crankpins, said crankpins having respective axes positioned symmetrically with respect to said crankshaft axis;

a said eccentric collar rotatably mounted on each said crankpin and a said actuator operatively associated with each said crankpin, a said internal ring gear connected to each said eccentric collar, said internal ring gears being positioned at said web; and a said planetary gear meshing with each said internal ring gear and said sun gear.

11. A variable-stroke crank mechanism according to claim 10, wherein said web is positioned axially centrally of said double crankshaft between said crankpins, further comprising a main shaft having a pair of main shaft portions, said crankpins having ends press-fitted in said main shaft portions, respectively, said main shaft being relatively rotatable about said crankshaft axis with respect to said casing.

12. A variable-stroke crank mechanism according to claim 10, wherein said planetary gears are rotatable about respective axes which are positioned symmetrically with respect to said crankshaft axis, and wherein said crankshaft axis, said axes about which the planetary gears are rotatable, and said axes of the crankpins are positioned in one plane.

13. A variable-stroke crank mechanism according to claim 10, wherein said planetary gears are rotatable about respective axes which are positioned symmetrically with respect to said crankshaft axis, and wherein a plane passing through axes about which the planetary gears are rotatable and said crankshaft axis, and a plane passing through said axes of the crankpins and said crankshaft axis extend perpendicularly to each other.

14. A variable-stroke crank mechanism according to claim 10, wherein said means for causing angular adjustment of said sun gear and said sun gear are disposed eccentrically with respect to said crankshaft axis.

15. A variable-stroke crank mechanism according to claim 10, wherein said means for causing angular adjusting of said sun gear is a stroke adjusting shaft extending in the axial direction of said crankshaft and sun gear is integrally formed with an end of said stroke adjusting shaft.

16. A variable-stroke crank mechanism according to claim 15, wherein said sun gear is disposed in a gear insertion space defined in said web and coupled to an end of said stroke adjusting shaft in said one of the crankpins.

17. A variable-stroke crank mechanism according to claim 9, wherein a plurality of said actuators are providing in said casing, each said actuator comprising a plunger slidable within a cylinder provided on said casing for pumping a fluid.

18. A variable-stroke crank mechanism according to claim 17, wherein a radial valve mechanism is provided in said casing and operated by rotation of said crankshaft to selectively allow the fluid to flow to and from each said cylinder for each said plunger to pump the fluid in the respective cylinder.

19. A variable-stroke crank mechanism according to claim 18, wherein said radial valve mechanism includes a spool valve extending radially adjacent each said cylinder, a cam ring encircling said spool valves, means for causing rotation of said cam ring with and about said crankshaft axis, and said cam ring having inwardly extending cam lobes for causing radial movement of said spool valves upon said rotation of said cam ring for allowing said selective fluid flow.

20. A variable-stroke crank mechanism according to claim 19, wherein the number of cam lobes equals the number of spool valves.

21. A variable-stroke crank mechanism according to claim 19, wherein the number of cam lobes is a multiple of the number of spool valves, and said crankshaft is rotated at a speed that is the same multiple faster than the speed of rotation of said cam ring.

22. A variable-stroke crank mechanism according to claim 19, wherein means are provided for selectively and angularly adjusting the rotational position of said cam ring relative to said crankshaft.

* * * * *